US006949002B2

(12) United States Patent
Yamaguchi et al.

(10) Patent No.: US 6,949,002 B2
(45) Date of Patent: Sep. 27, 2005

(54) PLAY EXTENSION SYSTEM AND PROGRAM FOR THE SAME

(75) Inventors: Takashi Yamaguchi, Tokyo (JP); Kazuyuki Saeki, Tokyo (JP)

(73) Assignee: Konami Corporation, Tokyo (JP)

( * ) Notice: Subject to any disclaimer, the term of this patent is extended or adjusted under 35 U.S.C. 154(b) by 445 days.

(21) Appl. No.: 09/989,292

(22) Filed: Nov. 20, 2001

(65) Prior Publication Data

US 2002/0187725 A1 Dec. 12, 2002

(30) Foreign Application Priority Data

Jun. 6, 2001 (JP) ..... 2001-171663
Jul. 9, 2001 (JP) ..... 2001-208268

(51) Int. Cl.[7] ..... A63F 30/04; G08C 19/00
(52) U.S. Cl. ..... 446/454; 340/825.69
(58) Field of Search ..... 446/454–456, 446/463, 439; 463/39–40, 62–63; 340/825.2, 825.68, 825.69, 825.72, 5.8; 345/156

(56) References Cited

U.S. PATENT DOCUMENTS 5,452,901 A * 9/1995 Nakada et al. ..... 446/454
5,888,135 A * 3/1999 Barton et al. ..... 463/39
6,083,104 A * 7/2000 Choi ..... 463/6
6,246,927 B1 * 6/2001 Dratman ..... 700/246
6,247,994 B1 * 6/2001 DeAngelis et al. ..... 446/454
6,317,714 B1 * 11/2001 Del Castillo et al. ..... 704/270
6,380,844 B2 * 4/2002 Pelekis ..... 340/5.8
6,390,883 B1 * 5/2002 Choi ..... 446/436
6,546,436 B1 * 4/2003 Fainmesser et al. ..... 710/5
6,656,012 B1 * 12/2003 DeAngelis et al. ..... 446/454
6,705,873 B2 * 3/2004 Higashida ..... 434/393
6,773,344 B1 * 8/2004 Gabai et al. ..... 463/1
2002/0187726 A1 * 12/2002 Yamaguchi ..... 446/454

FOREIGN PATENT DOCUMENTS

| | | |
|---|---|---|
| DE | 9114929 | 2/1992 |
| GB | 2020450 | 11/1979 |
| JP | 10-225442 | 8/1998 |
| JP | 2000-229177 | 8/2000 |
| KR | 2000-37217 | 7/2000 |

OTHER PUBLICATIONS

Tim Chown; "F1 Racing Simulation"; Games Domain, Jan. 1998; XP002133467.
"Radio remote–control system for controlling e.g. remote control car"; Database WPI, 2000, XP002957548.

* cited by examiner

*Primary Examiner*—Jessica Harrison
*Assistant Examiner*—Alex F. R. P. Rada, II
(74) *Attorney, Agent, or Firm*—Jordan and Hamburg LLP

(57) ABSTRACT

The present invention provides a play extension system enhancing a fun of a toy system by use of network. The play extension system is used by combination with the toy system in which a user can change the setting of parameters affecting motion control of a driving machine, for extending a playing method with the toy system. In the system, the setting information corresponding to the setting state of the parameters is received from a predetermined user terminal through a network, and estimation on the obtained setting information is created by referring to a database which stores the setting information and the information for estimating the setting state correspondingly. The created estimation is transmitted to a predetermined destination through the network.

4 Claims, 22 Drawing Sheets

FIG.20A

ENTER YOUR PASSWORD .ONLY THE HALF ALPHANUMERIC IS VALID.

PASSWORD

220

FIG.20B

YOUR TOTAL ORDER IS 3RD IN THE AUTUMN LINK. STICK IT UNTIL WINNING THE FIRST PRIZE.

SEE THE ORDER LIST
RETURN

221

FIG.20C

AUTUMN LINK
TOP LIST(DISPLAY TOP 300)

| ORDER | NAME | TIME |
|---|---|---|
| 1 | AAA | 1:23:456 |
| 2 | BBB | 1:23:499 |
| 3 | CCC | 1:23:562 |

222

FIG.22

**********

RACE INVITATION CARD

**********

230

WE WILL INVITE YOU THE FOLLOWING RACE.

DATE: 9/16 (MON)
AM10:00 RECEPTION START
PLACE: □□□SHOP
SPECIAL COURSE ON THE ROOFTOP
GROUP: A
SETTING: 3588

PLAY EXTENSION SYSTEM AND PROGRAM FOR THE SAME

BACKGROUND OF THE INVENTION

1. Field of the Invention

The present invention relates to a play extension system which is used by combination with a toy system capable of changing the setting of parameters affecting motion control of a driving machine by a user, thereby enhancing the fun of a play with the toy system.

2. Description of the Related Art

In the toy system for remote-controlling a driving machine such as a vehicle and a vessel by using radio waves or infrared rays, there is some toy system in which a user can change the setting of a correspondence between an input operation to a remote-controlled transmission unit and a control amount of the driving machine moved according to the input operation. For example, as is well known, in a toy system capable of a user's remote-controlling a model car, the setting of a correspondence between the user's operation amount of a steering wheel (or lever) provided on the transmission unit and the actual steering amount of the wheel corresponding to it, can be changed by a user, and therefore, the steering characteristic of a car can be adjusted according to the taste of a user.

In a conventional toy system, according as the number of the settable parameters is increased, reality of the toy is more enhanced. On the contrary, however, a user's trouble of finding out a proper setting for each parameter is also increased. Therefore, if the system is provided with a lot of the settable parameters, a class of users is limited to such a personality that is not troubled by the above setting. In the user's individual setting, even if a user finds a proper setting, it may prove to need improvement, or a user may lose interest in the play thereafter because of the above trouble, without making full use of the prepared setting change function, regardless of the existence of the worthy setting.

SUMMARY OF THE INVENTION

Accordingly, it is an object of the present invention to provide a play extension system capable of enhancing the fun of a toy system by using a network.

In order to achieve the above object, there is provided a play extension system to be used by combination with a toy system in which a user can change setting of parameters affecting motion control of a driving machine, the system comprising: an information obtaining device for receiving setting information corresponding to a setting state of the parameters from a predetermined user terminal through a network; an estimation creating device for creating estimation of the setting information obtained by the information obtaining device, referring to a database in which the setting information and information for estimating the setting state are stored correspondingly with each other; and an estimation transmission device for transmitting the created estimation to a predetermined destination through the network.

According to the play extension system, a user can receive an objective estimation on the setting state of parameters of the driving machine through the network. Accordingly, a user can change the set value of a parameter based on the obtained estimation, so as to improve the control characteristic of the driving machine, or so as to try the lower-estimated setting, and thereby, various playing ways can be created based on the information provided through the network. Therefore, a playing method of the toy system can be extended, hence to enhance the fun of the toy system.

The toy system may present the information for specifying the user's setting state of a plurality of parameters to the user, and the information obtaining device may obtain the information presented to the user by the toy system, from the user terminal, as the setting information. In this case, the information presented by the toy system to a user can be transmitted from the user terminal as it is as the setting information. Therefore, a user can use the play extension system at ease.

The toy system may comprise a driving machine and a transmission unit for a user's remote-controlling of the driving machine, and the settable parameters may affect a correspondence between an input operation of the transmission unit and a control amount of the driving machine based on a control signal transmitted from the transmission unit to the driving machine. In this case, a user can change the steering characteristic of the driving machine by use of the transmission unit, referring to the estimation given through a network.

Information of sentences expressing characteristic of the setting state specified in the setting information and/or information of sentences for giving a clue to improvement of the setting state to a user may be stored in the database as the information for estimating.

The estimation transmission device may transmit to the user terminal, through the network, the information for presenting the sentences to a user as at least one part of the estimation information. In this way, a user can watch the estimation on the user terminal easily and understand the estimation at once because the estimation is expressed in sentences.

According to another aspect of the present invention, there is provided a play extension system to be used by combination with a toy system in which a user can change setting of parameters affecting motion control of a driving machine, the play extension system comprising: an electronic information providing device for providing a user terminal operated by each user with electronic information for displaying on a screen of the user terminal a state of a game virtually reproducing a play with the driving machine in the toy system, upon receipt of access from a plurality of users through a predetermined network; a game result storing device for storing a result of the game, which is displayed on the screen of each user terminal, so as to be associated with information specifying the user; a privilege issuing device for issuing a predetermined privilege at least to some user, referring to the result of the game stored in the game result storing device; and a privilege notifying device for transmitting information associated with the privilege to a destination corresponding to a privileged user, wherein, in the game based on the electronic information provided by the electronic information providing device, a user's setting operation of the same type of parameter as a user's settable type of parameter in the toy system is required and the set parameter affects the result of the game.

According to the play extension system described above, a user can enjoy the toy system virtually through a game displayed on the screen of the user terminal. Further, in a game, a user can perform the setting operation of the same type of parameter as a type of parameter settable in the toy system, which makes a user feel a relationship and a sense of togetherness of a play in the toy system and a game reproduced by the game of the toy system strongly. Therefore, a user's playing method of the toy system can be extended from the individual and local use only by the toy system to the wide use through a network.

A game may be executed on the play extension system, or on the user terminal. In the former case, the electronic information provided to the user terminal includes the data for displaying the state of the game on the user terminal, while in the latter case, the electronic information provided to the user terminal includes a program executable on the user terminal. The information specifying a user may be the user ID and the like. If a destination corresponding to a user is included in the information specifying a user, it is possible to specify the destination of a privilege easily.

The parameter to be input in the game may affect a motion characteristic of a driving machine appearing in the game and the result of the game may vary depending on the motion characteristic. In this case, it is possible to realize a common performance between the operation of changing the driving characteristic of the driving machine by setting a parameter in the toy system and the operation of changing the driving characteristic of the driving machine by setting a parameter on the game. Therefore, a user can be impressed with extension of the playing form with the toy system thanks to a service provided through a network.

The privilege issuing device may specify a user who has obtained the game result equal to or superior to a predetermined level, referring to the stored game result, and may issue the privilege to the specified user.

The privilege issuing device may issue an entry right to a specified meeting using the toy system as the privilege, and the privilege notifying device may transmit the information for notifying the issue of the entry right, to the destination, together with the information on an entry condition of the meeting, as the information on the privilege. In this case, the play extension system can be used as device for inducing a user to enter an actual meeting by use of the toy system.

The game result storing device may store the result of the game so as to be associated with the parameter input by the user, and the privilege notifying device may transmit the information specifying the parameter stored by the game result storing device correspondingly to the game result which has generated the entry right to the meeting, as the information on the entry condition to the meeting.

According to still another aspect of the present invention, there is provided a program for constructing a play extension system by one or a plurality of servers of a Web site, which system is used by combination with a toy system in which a user can change setting of parameters affecting motion control of a driving machine, wherein the program for the play extension system is designed to work the server as: an information obtaining device for receiving setting information corresponding to a setting state of the parameters from a predetermined user terminal through a network; an estimation creating device for creating estimation of the setting information obtained by the information obtaining device, referring to a database in which the setting information and information for estimating the setting state are stored correspondingly with each other; and an estimation transmission device for transmitting the created estimation to a predetermined destination through the network.

Another program of the present invention is a program for constructing a play extension system by one or a plurality of servers of a Web site, which system is used by combination with a toy system in which a user can change setting of parameters affecting motion control of a driving machine, wherein the program for a play extension system is designed to work the server as: an electronic information providing device for providing a user terminal operated by each user with electronic information for displaying on a screen of the user terminal a state of a game virtually reproducing a play with the driving machine in the toy system, upon receipt of access from a plurality of users through a predetermined network; a game result storing device for storing a result of the game, which is displayed on the screen of each user terminal so as to be associated with information specifying the user; a privilege issuing device for issuing a predetermined privilege at least to some user, referring to the result of the game stored in the game result storing device; and a privilege notifying device for transmitting information associated with the privilege to a destination corresponding to a privileged user, and in the game based on the electronic information provided by the electronic information providing device, a user's setting operation of the same type of parameter as a user's settable type of parameter in the toy system is required and the set parameter affects the result of the game.

According to these programs, the play extension system of the present invention can be formed by using the server of the Web site.

The above programs may be provided to a market in a state of being stored in a storing medium, or delivered to a market through a wired or wireless network. The "play extension system" of the present invention means a system in which the playing form provided by the toy system is extended by a service provided through a network.

BRIEF DESCRIPTION OF THE DRAWINGS

FIGS. 20A to 20C are diagrams showing an example of the screen displayed on the user terminal according to the processing of FIG. 19;

FIG. 22 is a diagram showing an example of the screen display of invitation card data transmitted to the user terminal according to the processing of FIG. 21.

DESCRIPTION OF THE PREFERRED EMBODIMENT

Figure 1:
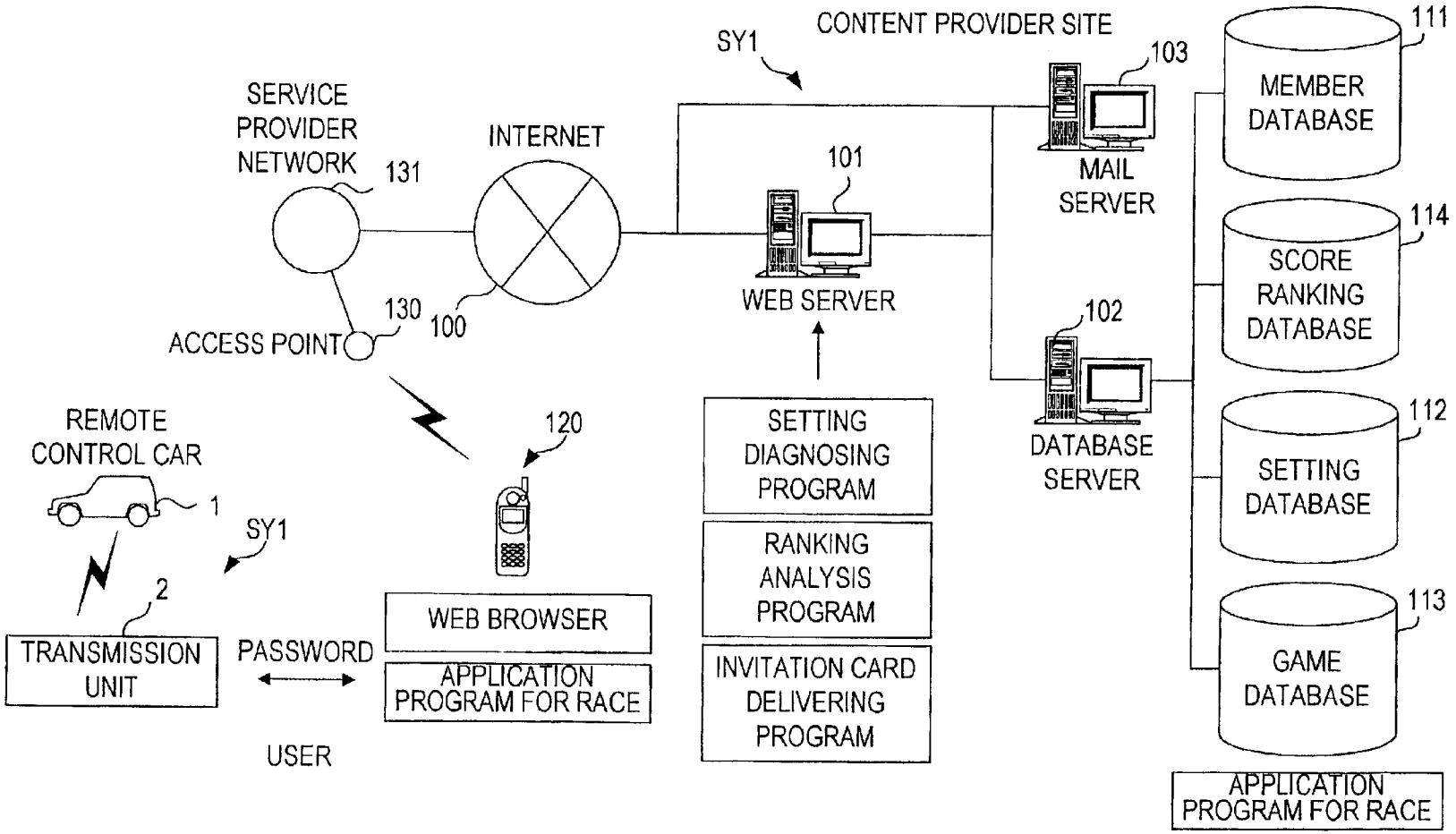
FIG. 1 is a diagram showing the structure of a toy extension system according to the present invention.

FIG. 1 shows a combination of a remote operational toy system SY1 and a play extension system SY2 according to an embodiment of the present invention. Hereinafter, the remote operational toy system SY1 and the play extension system SY2 will be explained by turn.

[Explanation of the Remote Operational Toy System]

The remote operational toy system SY1 is a system in which a user operates a driving machine 1 (here, a remote control car in this example) through a transmission unit 2 so as to enjoy a race together with another user.

Figure 2:
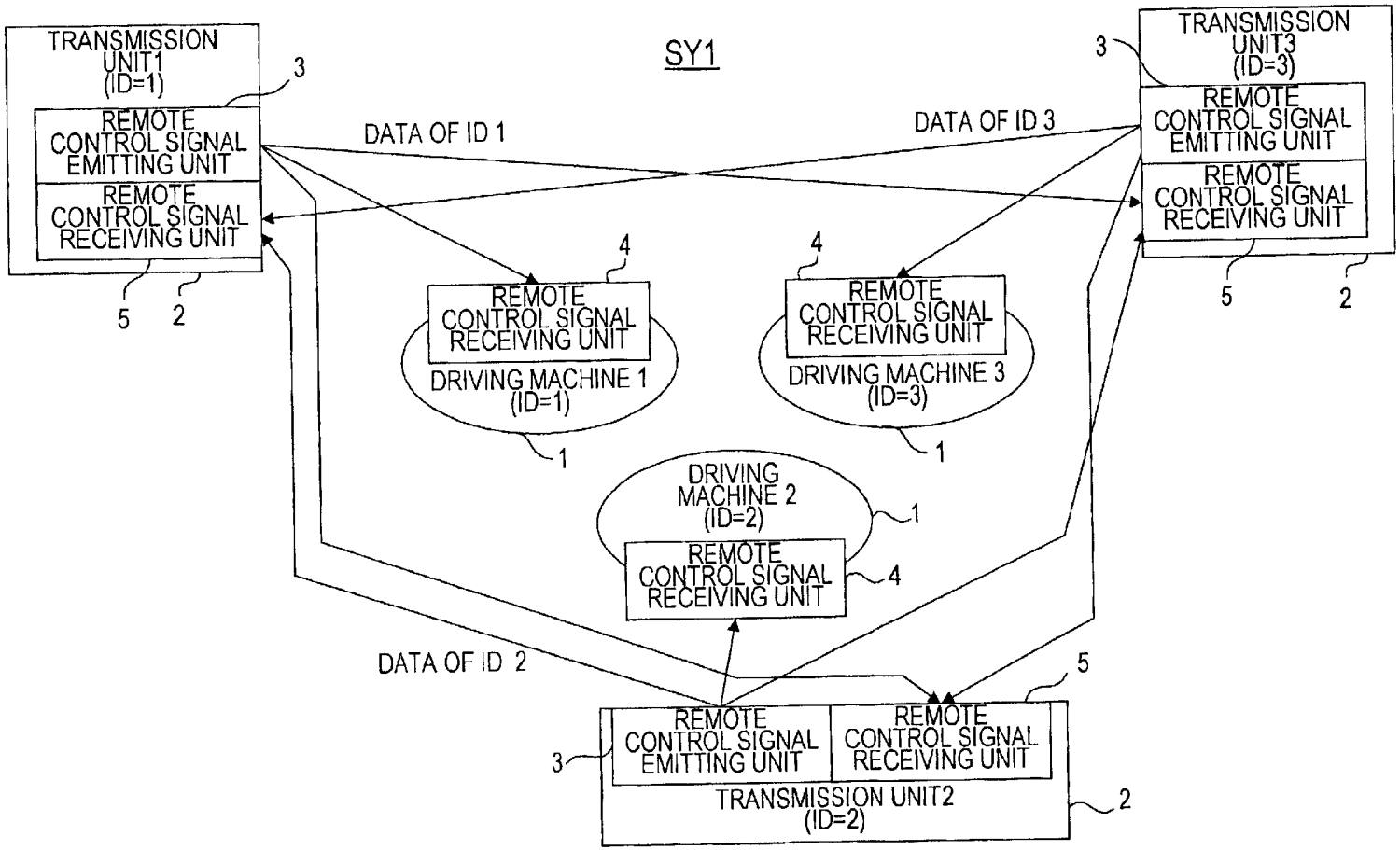
FIG. 2 is a diagram showing the schematic structure of a remote-controlled toy system combined with the play extension system of the present invention.

FIG. 2 is a diagram showing a schematic structure of the remote operational toy system SY1. In FIG. 2, it is assumed that three driving machines 1 . . . 1 are operated remotely at the same place. The transmission units, or sending units 2 . . . 2 are provided for the driving machines 1 in the one-to-one correspondence. The numbers 1 to 3 are respectively set at the driving machines 1 . . . 1 and the transmission units 2 . . . 2 as the identification number (ID). The driving machine 1 and the transmission unit 2 which have the same identification number are in a pair, and the driving machine 1 is remotely operated according to the data from the transmission unit 2 having the same identification number. An infrared ray is used for remote control of the driving machines 1. Therefore, a remote control signal emitting unit 3 is mounted on each of the transmission units 2 and a remote control signal receiving unit 4 is mounted on each of the driving machines 1. For synchronization of data transmission between the transmission units 2, a remote control signal receiving unit 5 is mounted on each of the transmission units 2.

Figure 3:
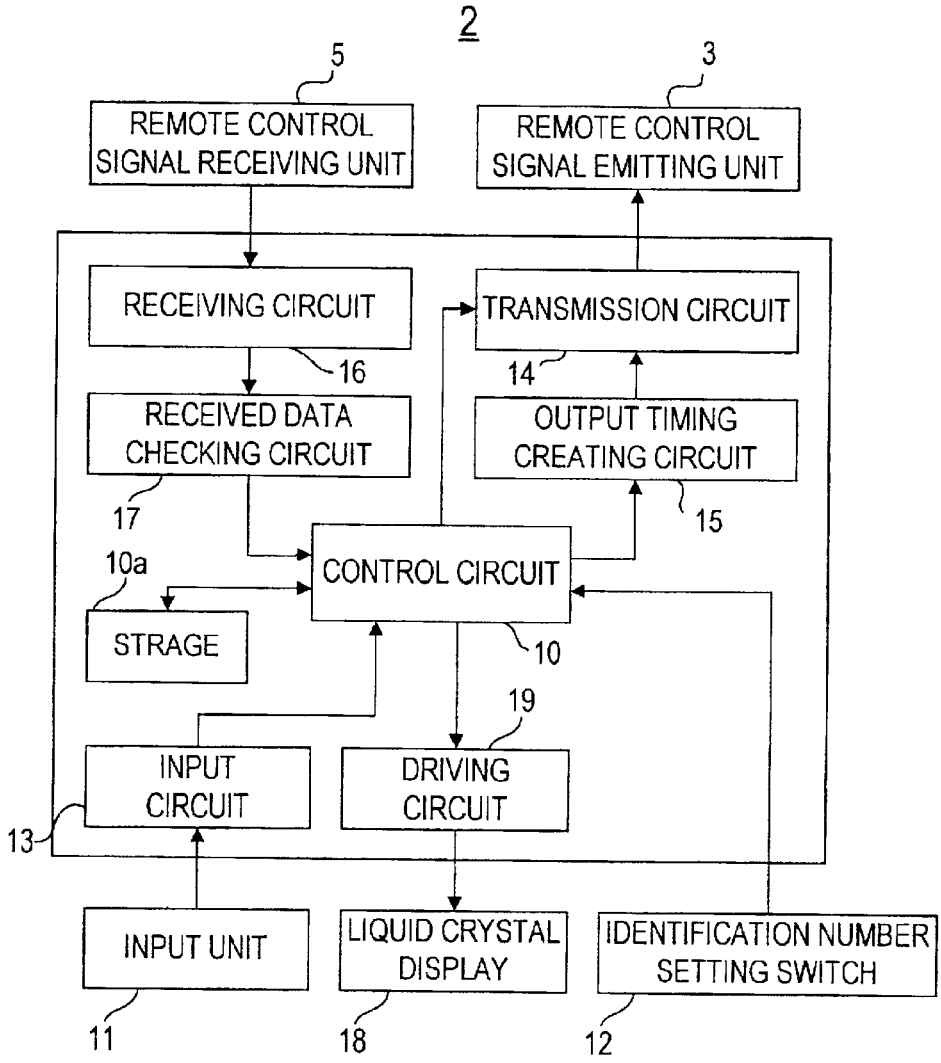
FIG. 3 is a diagram showing the circuitry of a transmission unit.

FIG. 3 shows a circuitry of the transmission unit 2. The transmission unit 2 is provided with the above-mentioned remote control signal emitting unit 3 and receiving unit 5, and further provided with a control circuit 10 for creating transmission data or controlling the other circuits, an input unit 11 of volume, switch, or operation key for controlling the operation of the driving machine 1, and a switch 12 for setting an identification number. The state of the input unit 11 operated by an operator is detected by an input circuit 13, and an operation signal depending on the state of the input unit 11 is supplied therefrom to the control circuit 10. The identification number set by the identification number setting switch 12 is read by the control circuit 10. The identification number setting switch 12 may be designed such that an operator or a system manager and the like can select any number from a predetermined range, or it may be designed such that a manufacturer of the transmission unit 2 previously fixes the identification number at a specified number. The control circuit 10 is formed by a combination of a microcomputer and a predetermined program.

The remote control signal emitting unit 3 is formed to include light emitting means, for example, an LED, thereby emitting an infrared ray according to an instruction from a transmission circuit 14. The transmission circuit 14 supplies the transmission data to the remote control signal emitting unit 3 according to the timing instructed by an output timing creating circuit 15. The data to be supplied to the remote control signal emitting unit 3 is created by the control circuit 10 and the transmission circuit 14 modulates the data created by the control circuit 10 through a carrier signal for remote control, so to drive the remote control signal emitting unit 3. The output timing creating circuit 15 counts the time according to the timer set value given from the control circuit 10 and supplies a transmission instruction to the transmission circuit 14 when the time corresponding to the timer set value elapses. The frequency of the infrared carrier signal supplied from the remote control signal emitting unit 3 is the same in all the transmission machines 2.

Figure 4:
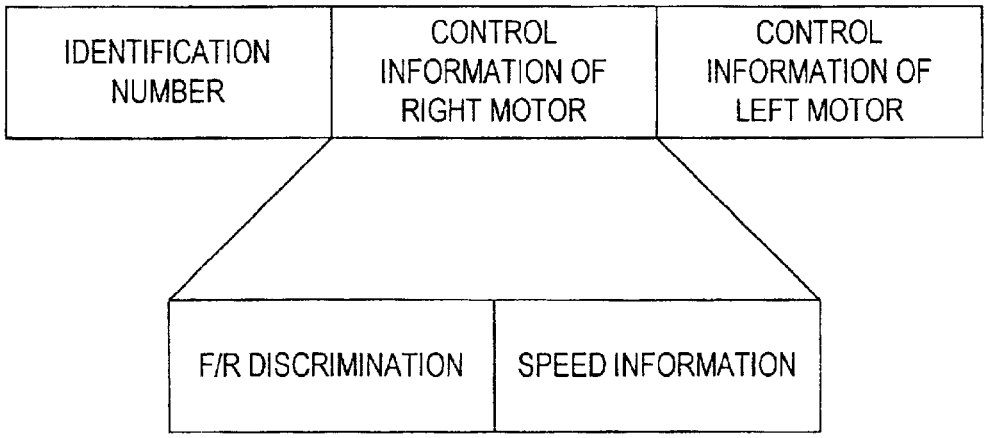
FIG. 4 is a diagram showing the structure of one block of remote control data supplied from the transmission unit.

While, the remote control signal receiving unit 5 receives an infrared ray transmitted from the other transmission unit 2, and supplies the signal obtained by eliminating the carrier component from the received infrared ray to a receiving circuit 16. The receiving circuit 16 decodes the signal given from the remote control signal receiving unit 5 into remote control data for one block and supplies it to a received data checking circuit 17. The remote control data for one block is formed by the identification number and the control information of a pair of right and left motors provided in the driving machine 1 (motors 28 and 28 of FIG. 5), as illustrated in FIG. 4. The control information of the right and left motors is further formed by the information for discriminating whether the rotating direction of each motor is a forward direction or a rearward direction (F/R discrimination) or it is stopped and the information for specifying the moving speed of the motors. The moving speed of the motors can be specified respectively in eight steps from 1 to 8.

The correspondence between the operation amount of the input unit 11 and the motor control information can be changed in a predetermined range by a user operating the input unit 11. The setting content is stored in a storage 10*a*. The storage 10*a* is formed by a combination of a nonvolatile semiconductor memory, for example, EEPROM, and a RAM working as a work area of the control circuit 10. One example of the correspondence between the input unit 11 and the motor control information will be described later. Here, the number of bits in one block of the remote control data is always constant. Therefore, the time taken to transmit one block of the remote control data is also constant.

The received data checking circuit 17 checks the identification number of the received data given from the receiving circuit 16 and supplies the check result to the control circuit 10. The control circuit 10 controls the operation of the transmission circuit 14 and the output timing creating circuit 15 according to the information given from the received data checking circuit 17, the identification number setting switch 12, and the input circuit 13. The control circuit 10 checks interference and sets the timing to supply the transmission data of this transmission unit 2, based on the identification number of the received data given from the received data checking circuit 17 and the identification number of this transmission unit 2 set by the identification number setting switch 12. According to the set output timing, the control circuit 10 sets the timer set value for the output timing creating circuit 15. Further, the control circuit 10 creates the transmission data to the driving machine 1 having the same identification number as this transmission unit 2, based on the information given from the identification number setting switch 12 and the input circuit 13, and supplies the transmission data to the transmission circuit 14.

A liquid crystal display 18 is further provided in the transmission unit 2. The liquid crystal display 18 is to display the setting state of the transmission unit 2, and the display content is controlled by the control circuit 10 through a driving circuit 19.

Although a power switch and the like are also connected to the control circuit 10 in addition to the above, they are omitted. Alternatively, two and more remote control signal receiving units 5 may be provided in one transmission unit 2 in a way of detecting a signal in various directions. The transmission circuit 14, the output timing creating circuit 15, the receiving circuit 16, and the received data checking circuit 17 may be formed by a logic circuit, or they may be formed by a combination of a microcomputer and a predetermined program, similarly to the control circuit 10. At least one of the output timing creating circuit 15 and the received data checking circuit 17 may be integrated in the control circuit 10.

Figure 5A:
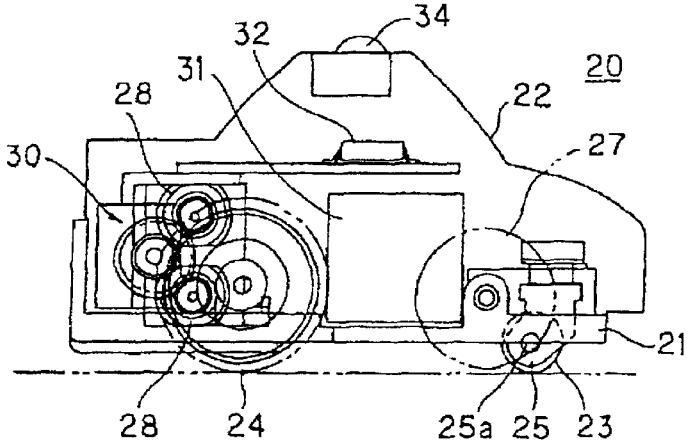
FIGS. 5A to 5C are a diagrams showing a model car as one embodiment of a driving machine.
Figure 5B:
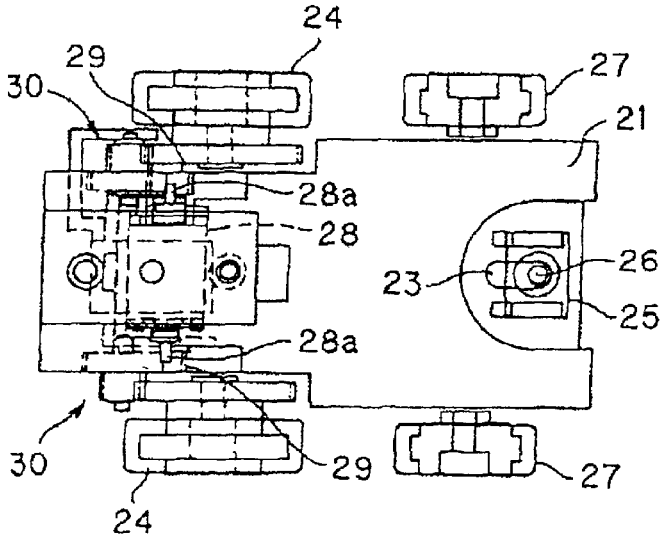
Figure 5C:
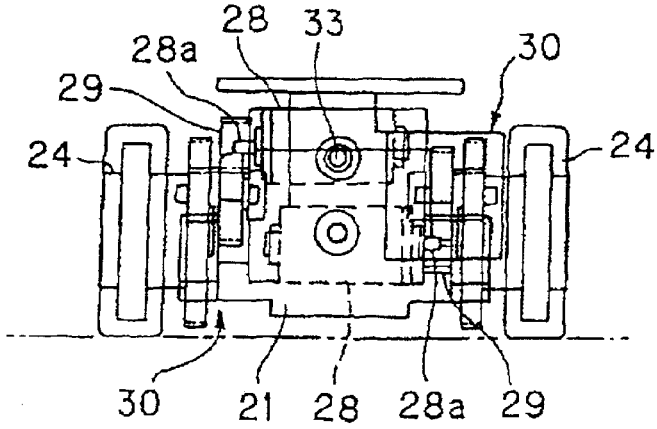

FIG. 5A is a side elevation view of one embodiment of the driving machine 1, FIG. 5B is a bottom view thereof, and FIG. 5C is a rear elevation view thereof. In this embodiment, the driving machine 1 is formed as a compact model car 20. The model car 20 has a chassis 21 and a body 22 which covers the chassis. A front wheel 23 is provided in the front center of the chassis 21 and a pair of right and left rear wheels 24 and 24 are provided in the rear portion. The front wheel 23 is mounted on a support leg 25 through an axle shaft 25*a* in a rotatable way. The support leg 25 is mounted on the chassis 21 in a rotatable way around a cornering axis 26 in a vertical direction. This enables the front wheel 23 to rotate 360° freely about the cornering axis 26. Though dummy wheels 27 and 27 are mounted on the chassis 21 in the front right and left, the dummy wheels 27 and 27 are floated and the chassis 21 is supported by the front wheel 23 and the rear wheels 24 and 24.

Motors 28 and 28 are provided in the rear portion of the chassis 21, in a way of laying one on the top of the other. The motors 28 and 28 are provided in order to drive the rear wheels 24 and 24 separately. A pinion 29 is mounted on an output axis 28*a* of each motor 28, and the rotation of the pinion 29 is transmitted through a gear string 30 to the rear wheel 24 to be driven. Since the right and left rear wheels 24 and 24 are separately driven by the motors 28 and 28 as mentioned above, the rotation speed of the motors 28 and 28 can be varied in the right motor 28 and the left motor 28,and only one motor 28 may be driven or the motors 28 and 28 may be rotated in a direction different from each other, thereby giving the model car 20 a variety of cornering.

A battery 31 is provided in front of the motors 28, and a controller 32 formed, for example, as a one-chip microcomputer is provided over the battery. In the rear portion of the chassis 21, an LED 33 for checking the power-on/off is provided. Further, a remote control signal receiving unit 34 for receiving an infrared ray from the transmission unit 2 is provided in the top middle portion of the body 22.

Figure 6:
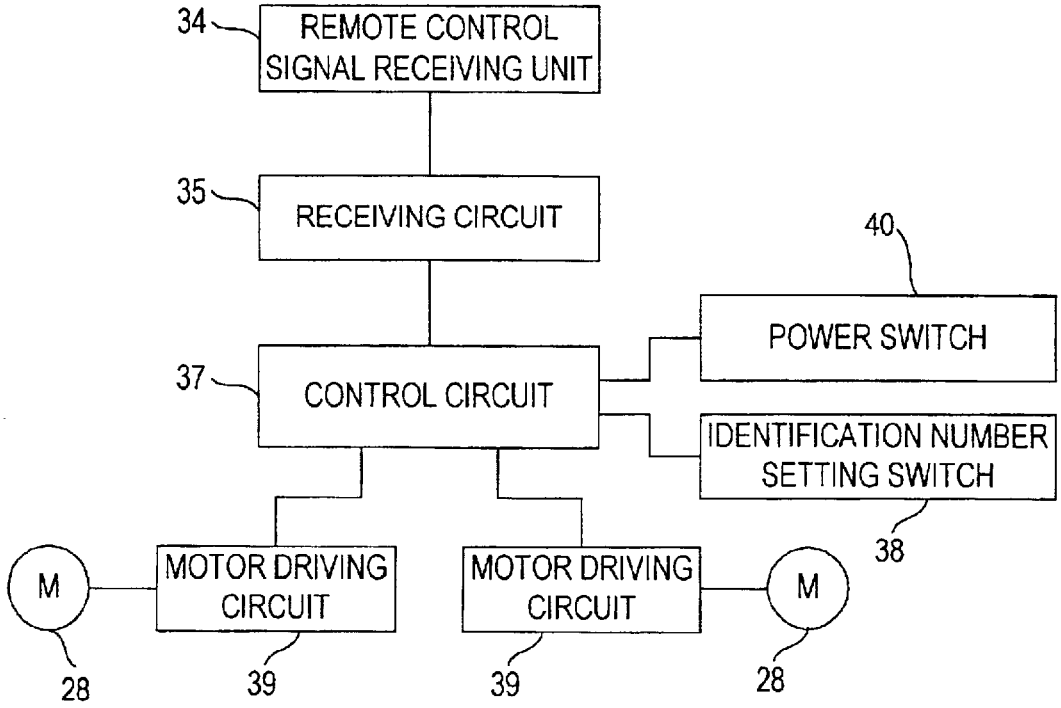
FIG. 6 is a diagram showing the circuitry of a control system mounted on the model car.

FIG. 6 shows a circuitry of a control system mounted on the model car 20. The above-mentioned remote control signal receiving unit 34 is provided in the model car 20. The remote control signal receiving unit 34 receives an infrared ray transmitted from the transmission unit 2 and supplies the signal obtained by eliminating a carrier component from the received infrared ray to a receiving circuit 35. The receiving circuit 35 decodes the signal given from the remote control signal receiving unit 34 into one block of remote control data and supplies it to a control circuit 37. The remote control data for one block is as shown in FIG. 4. The control circuit 37 checks the identification number of the received data given from the receiving circuit 35 and checks the validity or invalidity of the remote control data by comparison between the same identification number and the identification number set by an identification number setting switch 38. Namely, when both the identification numbers are not in one accord, it judges that the received remote control data is invalid and does not create a driving signal of the motors 28. On the other hand, when both the identification numbers are in one accord, it decides the rotation direction and the rotation speed of the motors 28 based on the motor control information of the remote control data given from the receiving circuit 35, and supplies the motor driving signal corresponding to the decided value to motor driving circuits 39 and 39. The motor driving circuits 39 and 39 control the rotation of the motors 28 and 28 based on the given motor driving signal. The identification number setting switch 38 may be designed such that an operator or a system manager and the like can select any number from a predetermined range, or it may be designed such that a manufacturer of the transmission unit 2 previously fixes the identification number at a specified number. A power switch 40 is also connected to the control circuit 37. The battery 31 and the LED 33 shown in FIG. 5 are omitted in FIG. 6.

When the remote control data is simultaneously transmitted from two and more transmission units 2 to the above-mentioned model car 20 and the identification number of the remote control data of one transmission unit 2 agrees with that of the model car 20, since the remote control data received at that time is regarded to be valid by the control circuit 37, there is a fear of malfunctioning the motors 28 because of the interference of the control information of the motor with the control information from the other transmission unit 2 having a different identification number. Then, in the remote control system of the embodiment, each transmission unit 2 specifies its own possible timing to transmit while receiving a remote control signal issued by the other transmission unit 2, thereby synchronizing the transmission timing so that the transmission timing of each transmission unit 2 does not overlap with each other. Hereinafter, this point will be described.

Figure 7:
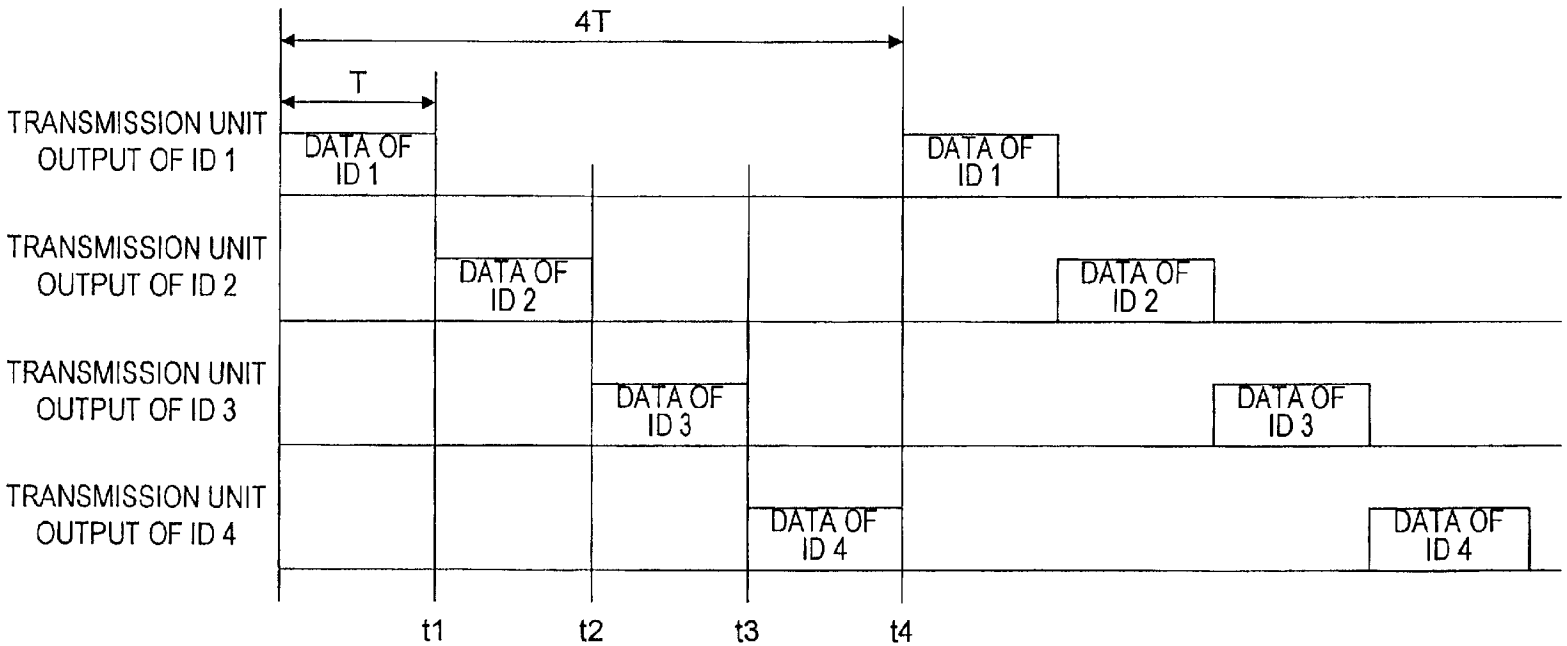
FIG. 7 is a diagram showing how to take transmission timing when four transmission units are simultaneously used.

FIG. 7 shows how to take transmission timing when four transmission units 2 are simultaneously used. In FIG. 7, the time length of one transmission unit 2 transmission a remote control signal is defined as T, and each transmission unit 2 repeats transmission of the remote control signal in a cycle corresponding to the number of the transmission units 2×transmission time T(=4T). The transmission timing of the transmission units 2 is deviated from each other by T sequentially from the transmission unit 2 of the identification number 1. The transmission timing of the transmission units 2 is controlled according to that relationship, thereby preventing overlap of the transmission time of the four transmission units 2. In order to realize such a transmission control, for example, the transmission unit 2 of the identification number 2 in FIG. 7 should be controlled at the following transmission timing.

When receiving the data of the identification number 1 at the time t1, the transmission unit 2 of the identification number 2 starts output of its own transmission data and completes the output of its own transmission data at the time t2. It checks the received data of the receiving circuit 16 (refer to FIG. 3) at the completion of the transmission and confirms that there occurs no interference of signals. Thereafter, it sets the transmission timer for counting the next output timing at 3T and starts the timer count.

When receiving the remote control data of the identification number 3 at the time t3, the transmission unit 2 sets the transmission timer at 2T again and starts the timer count. When receiving the remote control data of the identification number 4 at the time t4, it sets the transmission timer at T again and starts the timer count.

When the power of the transmission unit 2 of the identification number 1 is turned off, or the transmission unit 2 of the identification number 2 cannot receive the data from the transmission unit 2 of the identification number 1 due to noise and the like, it should start the output of its own data at a point where the time T elapses in the transmission timer after receiving the data of the identification number 4. Even if it cannot receive a signal further from the other transmission unit 2, it can continue the output of the transmission data at a cycle of 4T by making use of the time 3T which is set in the transmission timer at the completion of transmission its own data.

Although the description has been made in the case of four transmission units 2, the transmission timing can be controlled similarly also in the case of five and more transmission units 2 by attaching so many identification numbers. The cycle of the transmission timing of the transmission units 2 becomes N×T (where N is the number of the transmission units). A space of no data transmission by any transmission unit may be interposed between the period of the data transmission by the transmission unit 2, thereby setting the whole cycle longer than NT.

Figure 8:
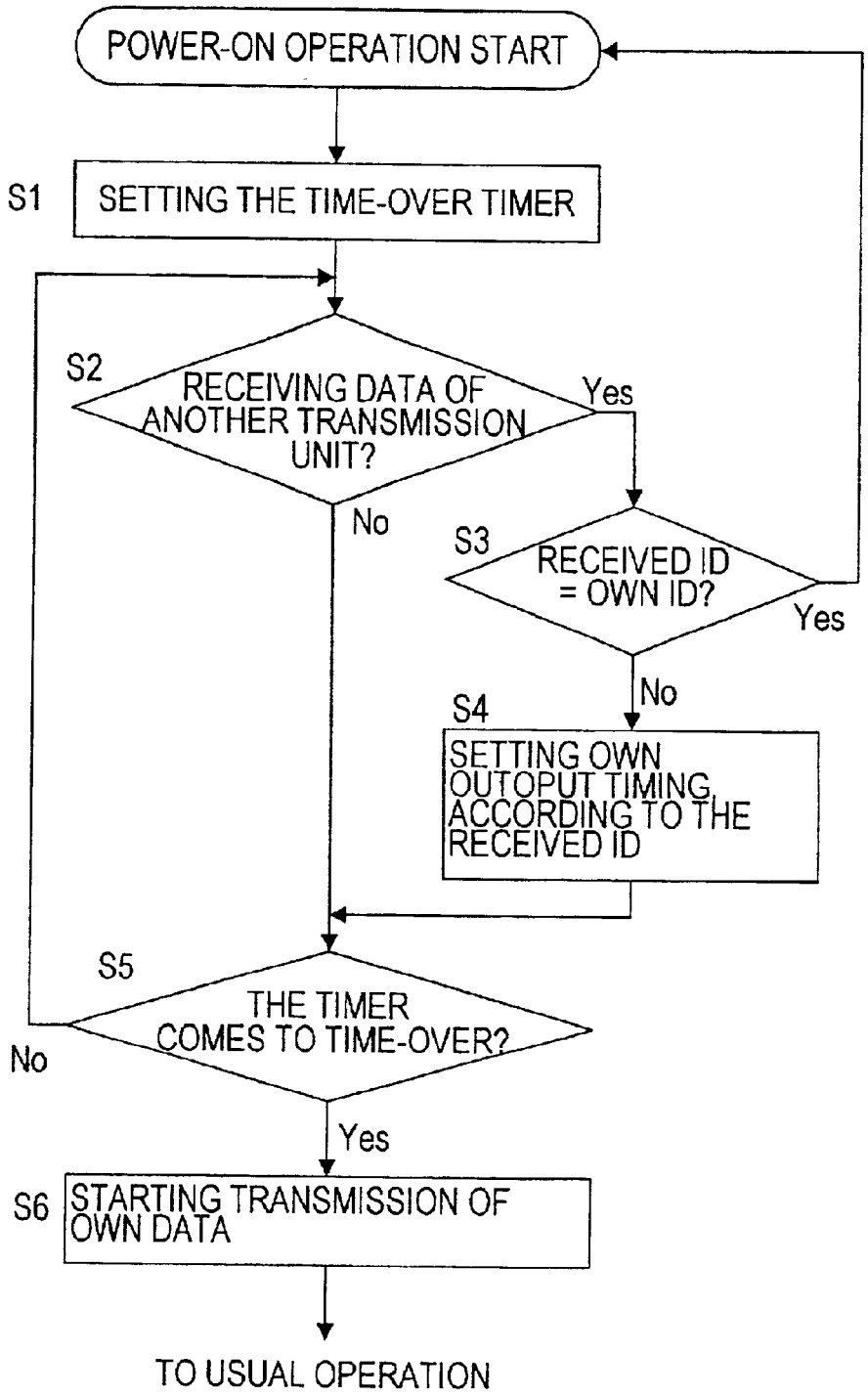
FIG. 8 is a flow chart showing the procedure of the power-on operation executed by a control circuit of the transmission unit from power supply to a start of transmission its own data.

FIG. 8 is a flow chart showing the procedure of the power-on operation to be executed by the control circuit 10 of the transmission unit 2 from the power supply to the start of the transmission of its own data. When the power is supplied, the timer for time over is set (Step S1). The control circuit 10 checks whether the data is received or not from the other transmission unit 2 (Step S2), and when it is received, it checks whether the identification number of the received data agrees with the identification number set for this transmission unit 2 (Step S3). When it agrees, this step will return to Step S1, where the checking operation is repeated. Thus, interference when there exist a plurality of the transmission units 2 having the same identification number can be prevented. When both the identification numbers are judged to be out of accord in Step S3, its own output timing is set according to the identification number of the other transmission unit 2 (Step S4). For example, when the transmission unit 2 of the identification number 2 in FIG. 7 receives the data of the identification number 3, its own output timing is set at 2T later.

It checks whether the timer set in Step S comes to time-over or not (Step S5), and if it doesn't come to time-over, this step will return to Step S2. When it comes to time-over, the transmission unit 2 starts transmission its own data (Step S6). Here, it is at a point of the output timing set in Step S4 that it actually starts the output. When no data is received until time-over, there is only the single operation of this transmission unit 2 and exists no other transmission unit 2, and therefore, it starts the data transmission immediately in Step S6.

Figure 9:
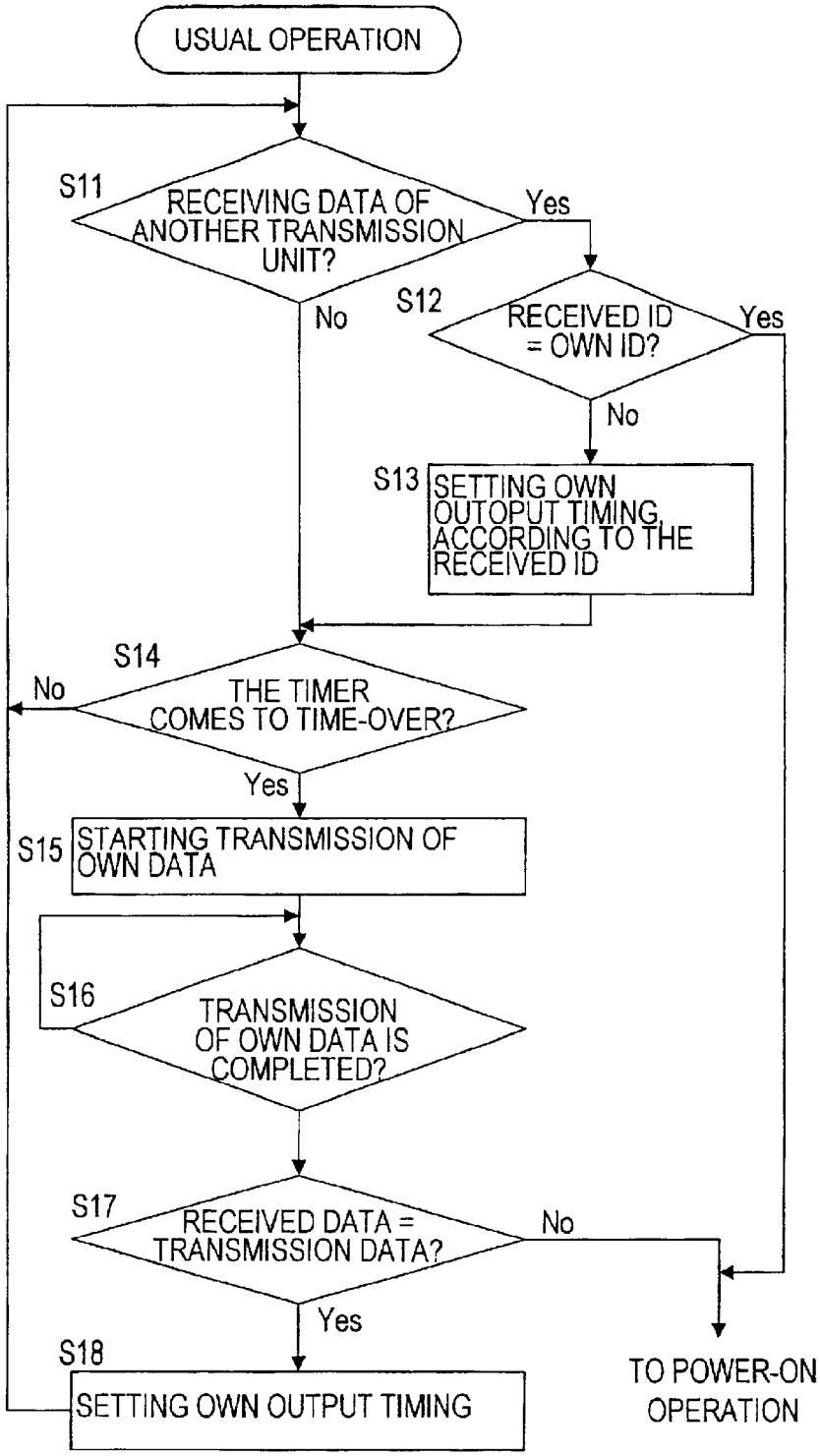
FIG. 9 is a flow chart showing the procedure of the usual operation executed by the control circuit of the transmission unit continuously to the processing of FIG. 8.

When the processing in Step S6 is completed, the control circuit 10 controls the data transmission according to the procedure of the ordinary operation of FIG. 9. In the ordinary operation, the control circuit 10 checks whether the data is received from the other transmission unit 2 or not (Step S11), and when it is received, it checks whether the received identification number agrees with the identification number set for this transmission unit 2 (Step S12). When it agrees, it returns to the power-on operation of FIG. 8. While, when the identification number of the received data does not agree with the identification number of this transmission unit 2, the output timing of this transmission unit 2 is set for the transmission timer according to the identification number of the received data (Step S13). It checks whether the transmission timer comes to timeout or not (Step S14), and this step will return to Step S repeatedly until it comes to timeout.

When it is judged to be timeout in Step S14, the control circuit 10 starts transmission its own data (Step S15). At this time, receiving data is also performed in parallel. It checks whether the data transmission is completed or not (Step S16), and when the transmission is completed, the transmitted data is compared with the data received in parallel to the transmission (Step S17). When it does not agree, it judges that interference has occurred and advances to the power-on operation of FIG. 8. When it agrees, it judges that no interference has occurred and the output timing of the next time is set for the transmission timer (Step S18). Then, this step will return to Step S1.

Figure 10A:
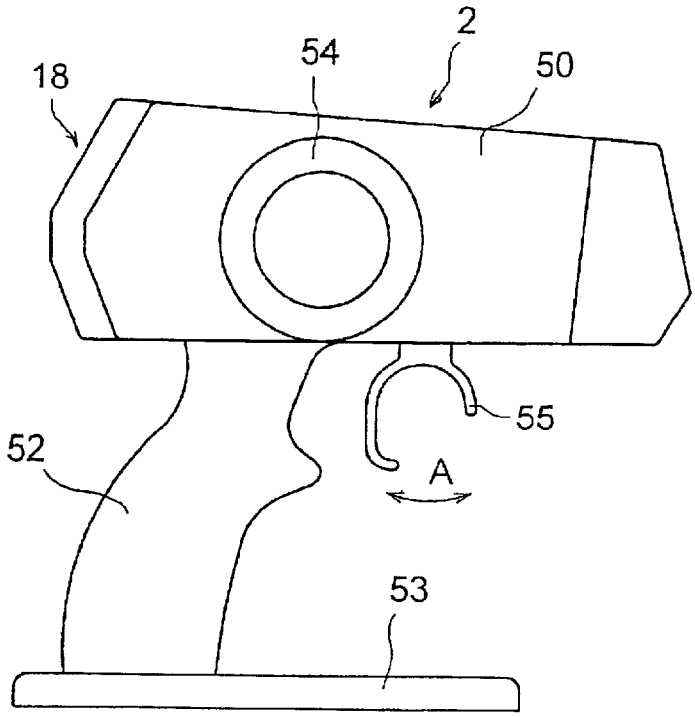
FIGS. 10A and 10B are diagrams showing the detail of the transmission unit.

FIG. 10A shows an appearance of the transmission unit 2. As illustrated in FIG. 10A, the transmission unit 2 is fully covered with a housing 50, and the housing 50 includes a main body 51, a grip portion 52, and a base portion 53. A user can hold the whole of the transmission unit 2 by gripping the grip portion 52 one-handed, alternatively he or she can stand the transmission unit 2 with the base portion 53 founded on a desk and the like.

On the main body 51, of the input unit 11, especially a steering 54 and a throttle lever 55 are provided as the operational material used for the operation of the driving machine 1. When the driving machine 1 is the model car 20, the steering 54 is used as the operation material for instructing steering of the model car 20 and the throttle lever 55 is used as the operation material for specifying the moving speed of the model car 20.

The steering 54 is protruded out of the housing 50 in a shape of a disc and it is designed as a variable register in which a resistance value varies according to the rotation amount around the center axis. The throttle lever 55 can be operated in a forward and backward direction (in a direction shown by the arrow A in FIG. 10A) curvedly around a non-illustrated supporting point provided inside the main body 51, and it is designed as a variable register in which a resistance value varies according to the rotation amount. A user can put his or her finger on the throttle lever 55 so as to operate it in a forward and backward direction. The steering 54 and the throttle lever 55 are respectively fixed to a predetermined center position by spring means not illustrated and if the user takes off the finger, they will return to the center positions by themselves. The center positions of the steering 54 and the throttle lever 55 are set at, for example, the respective centers of the operational ranges.

The resolution of the steering 54 and the throttle lever 55 is preferably set at the integral multiple of the resolution about the speed control of the motor 28 mounted on the model car 20. For example, when the rotation speed of the motors 28 is controlled respectively in eight steps in a forward direction and a backward direction, it is preferable that the resistance value to be set according to the operation amount of the steering 54 and the throttle lever 55 is varied by the integral multiple of 8 in both directions from the respective center positions.

Figure 10B:
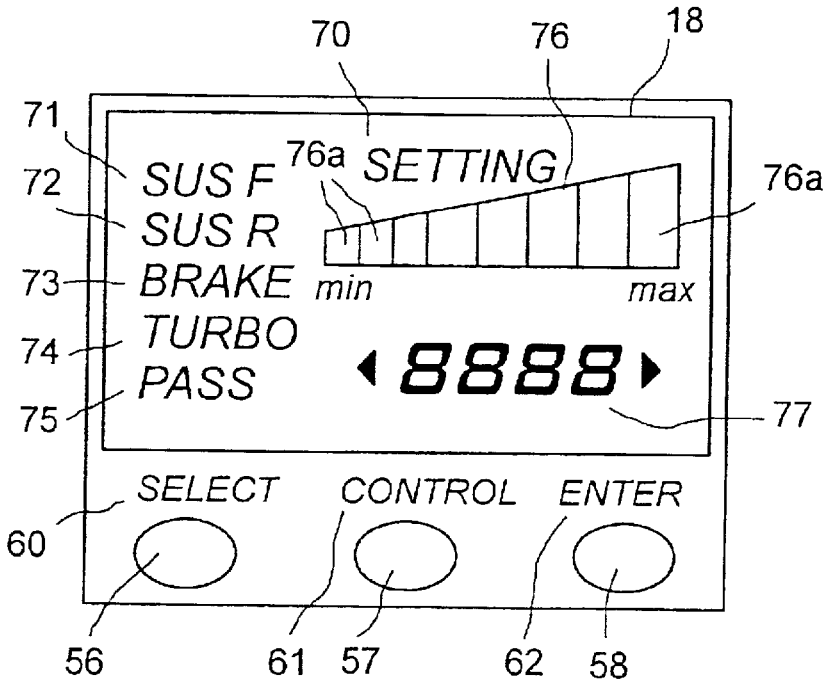

FIG. 10B shows the aspect on the left side of the main body 51 of FIG. 10A. As apparent from this figure, a liquid crystal display 18 is provided on the left side of the main body 51, and associated with the liquid crystal display 18, push-button switches 56, 57, and 58 for use in changing the setting of the correspondence between the operation amount of the steering 54 and the throttle lever 55 and the motor control information supplied depending on these operations are provided there. These push-button switches 56 to 58 also work as one of the input unit 11 of FIG. 3. The character information 60 to 62, "SELECT", "CONTROL", and "ENTER" from the left of FIG. 10B are respectively attached on the push-button switches 56 to 58. In the below, the push-button switches 56 to 58 may be sometimes referred to as the select button 56, the control button 57, and the enter button 58, respectively, to distinguish from each other.

FIG. 10B also shows a setting change screen 70 to be displayed on the liquid crystal display 18 at the above operation of changing the setting. On the left side of the setting change screen 70, there is displayed character information 71 to 74; "SUS F", "SUS R", "BRAKE", and "TURBO" respectively indicating four items as parameters which are changeable by a user and which affect the operation control of the model car 20. The character information 75, "PASS" is displayed below them. On the right side of the character information 71 to 75, there are displayed a setting gauge 76 divided into eight segments 76*a* . . . 76*a* and a password 77.

Hereafter, the setting items will be described.

The "SUS F" and "SUS R" are the setting items adapted for setting the hardness of a front suspension and a rear suspension of the model car 20. The "BRAKE" is the setting item adapted for setting the brake performance of the model car 20, and the "TURBO" is the setting item adapted for setting the acceleration and the maximum speed of the model car 20. Each of the setting items can be selected from eight steps; the minimum value 1 to the maximum value 8, and the segments 76*a* of the setting gauge 76 correspond to the number of steps. For example, when three segments from the left light up, the set value is 3. The password 77 is formed in a combination of the above four set values. For example, when the "SUS F" is 4, the "SUS R" is 7, the "BRAKE" is 6, and the "TURBO" is 5, the password 77 becomes "4765".

The correspondence between the above-mentioned setting items and the motor control information to be supplied to the model car 20 is previously set by a provider of the toy system SY1 as follows.

Figure 11A:
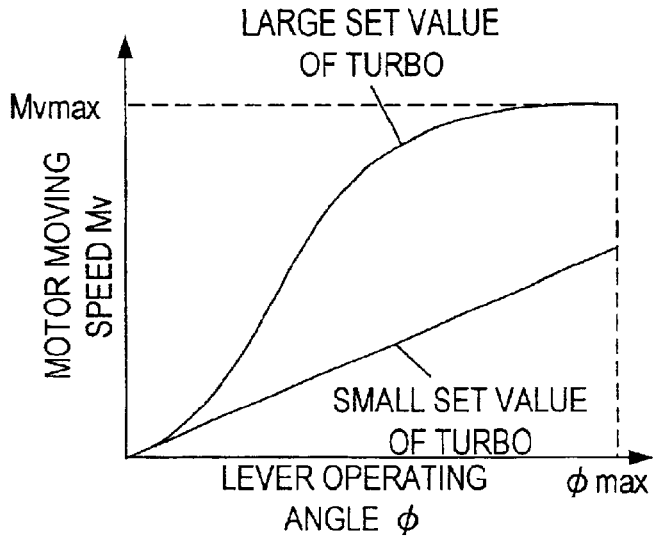
FIGS. 11A and 11B are diagrams showing the contents of the turbo setting and the brake setting.

As for the "TURBO", the correspondence between the moving speed Mv of the motor 28 and the operation amount $\phi$ of the throttle lever 55 when the model car 20 drives straight ahead, in other words, when there is no difference between the moving speed Mv of the left-motor 28 and the right motor 28 is changed depending on the set value of the "TURBO". For example, as illustrated in FIG. 11A, when the set value of the "TURBO" is small, the ratio of a change in the moving speed of the motor 28 to the operation amount $\phi$ of the throttle lever 55 from the neutral position is set small, and the maximum value Mvmax of the moving speed of the motor 28 is set small when the throttle lever 55 is operated at the maximum value $\phi$max.

On the contrary, when the set value of the "TURBO" is large, the ratio of a change in the moving speed Mv of the motor 28 to the operation amount $\phi$ of the throttle lever 55 from the neutral position is set large, and the maximum value Mvmax of the moving speed of the motor 28 is set large when the throttle lever 55 is operated at the maximum value $\phi$max. Thus, when the set value of the "TURBO" is large, the acceleration and the maximum speed become large, thereby having an effect as if supercharging an engine with a supercharger in a real car. If the acceleration becomes large, a delicate speed adjustment becomes difficult, and therefore, it is not always possible to obtain a favorable effect.

Figure 11B:
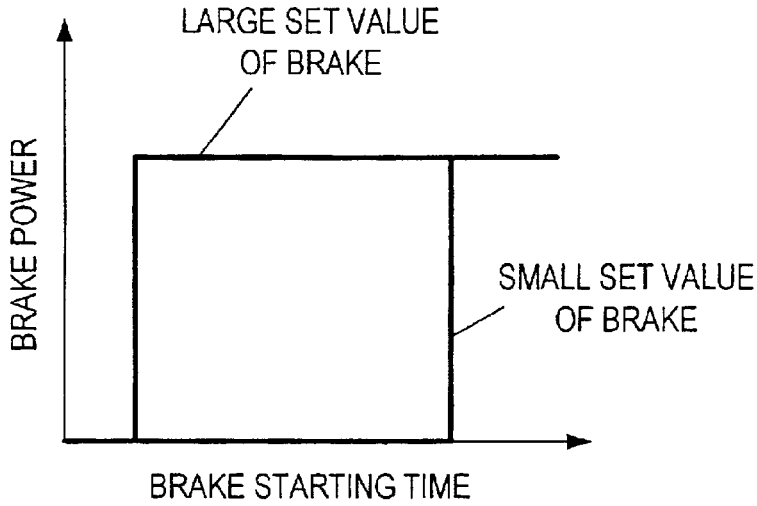

As for the "BRAKE", a time lag from returning the throttle lever 55 to the neutral position to producing a brake power by giving an instruction of normal rotation and inverse rotation to the motors 28 and 28 simultaneously is specified according to the set value. For example, as illustrated in FIG. 11B, when the set value of the "BRAKE" is small, a time lag from returning to the neutral position to giving a brake instruction is set long, and when the set value is large, a time lag from returning to the neutral position to giving a brake instruction is set short.

Further, as for the "SUS F" and the "SUS R", the correspondence between the operation amount $\theta$ of the steering 54 from the neutral position and the speed ratio Rv of the moving speed of the motors 28 and 28 is changed according to the difference $\Delta$SUS of these set values. Here, the speed ratio Rv means the value (Mv1/Mv2) obtained by dividing the moving speed Mv1 of the low-speed motor 28 by the moving speed Mv2 of the high-speed motor 28.

It is well known that in a general car, steering quality varies according to the difference of the hardness between a front suspension and a rear suspension. When the front suspension is relatively harder than the rear suspension, there appears such a steering quality that a car becomes difficult to turn, called under-steer, and when the front suspension is relatively softer than the rear suspension, there appears such a steering quality that a car becomes easy to turn, called over-steer.

In the remote operational toy system SY1 of this embodiment, the speed difference is produced between the two motors 28 and 28, hence to turn the model car 20. When the speed ratio of the motors 28 and 28 is smaller, the model car 20 becomes easier to turn, and when the speed difference is larger, the model car 20 becomes more difficult to turn. Therefore, even if the operation amount $\theta$ of the steering 54 from the neutral position is changed, as far as the speed ratio Rv of the motors 28 can be kept in about a state of straight ahead (=1), the under-steer quality such that a car would not turn even if operating the steering 54 can be realized. On the contrary, when the ratio of a change amount of the speed ratio Rv of the motors 28 to the operation amount $\theta$ of the steering 54 from the neutral position is set large, the over-steer quality so that the car turns too much for the operation of the steering 54 can be realized.

Then, the difference $\Delta$SUS obtained by subtracting the set value of the "SUS R" defining the hardness of the rear suspension from the set value of the "SUS F" defining the hardness of the front suspension is regarded as a parameter for deciding the turning ability, and correspondingly to the difference ΔSUS, the correspondence between the operation amount θ of the steering 54 and the speed ratio Rv of the motors 28 and 28 is changed.

Here, the proper speed ratio is changed according to the car speed. If the speed ratio is made too small, especially, at high speed driving, a cornering force rises up rapidly by the operation of the steering 54 and there occurs a rapid movement change like a spin. Accordingly, in the embodiment, the correspondence between the steering 54 and the speed ratio of the motors 28 and 28 is set in consideration of the relationship to the car speed, as illustrated in FIG. 12.

Figure 12A:
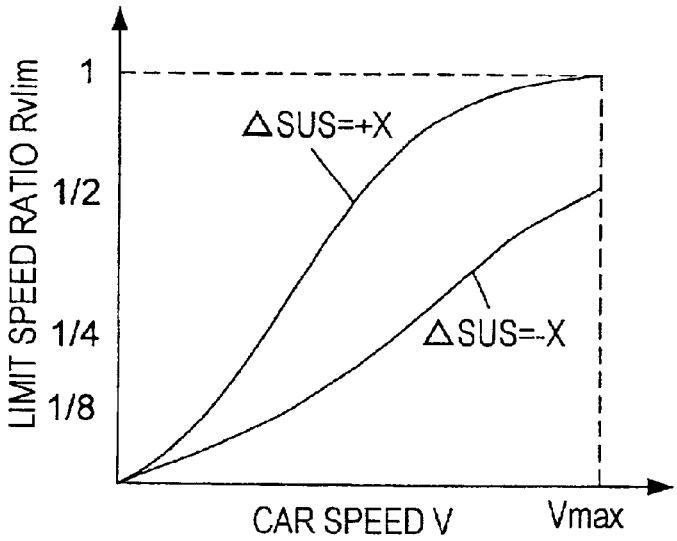
FIGS. 12A and 12B are diagrams showing a setting example of a correspondence between the operation amount of the steering and the speed ratio of the motors.

As illustrated in FIG. 12A, a line graph showing the relationship between the car speed V and the limit speed ratio Rvlim of the motor 28 is set for every ΔSUS. The maximum speed Vmax in FIG. 12A is the car speed when the operation amount of the throttle lever 55 is the maximum value ϕmax and varies depending on the set value of the "TURBO" as mentioned above (refer to FIG. 11A). Namely, the horizontal axis of FIG. 12A can be replaced by the operation amount ϕ of the throttle lever 55.

The limit speed ratio Rvlim of the motor 28 is the speed ratio occurring when the operating angle θ of the steering 54 is the maximum value θmax. Though the limit speed ratio Rvlim is more increased toward 1 according as the vertical axis of FIG. 12A goes up and up, that the limit speed ratio Rvlim approaches 1 means that the difference in the rotation speed between the right and left motors 28 and 28 becomes relatively small. Accordingly, FIG. 12A shows that the model car 20 becomes more difficult to turn by the operation of the steering 54 in the upper portion of the line graph. According to the setting example of FIG. 12A, since the limit speed ratio Rvlim more approaches 1 according as the speed of the car V is higher, a rapid change in the movement of the model car 20 at high speed driving can be prevented. When the ΔSUS is a positive value, a line graph is biased to the upper portion according as the ΔSUS becomes larger, thereby reproducing the under-steer quality such that the model car 20 becomes difficult to turn. On the contrary, when ΔSUS is a negative value, a line graph is biased to the lower portion according as the ΔSUS becomes smaller, thereby reproducing the over-steer quality such that the model car 20 becomes easy to turn.

Figure 12B:
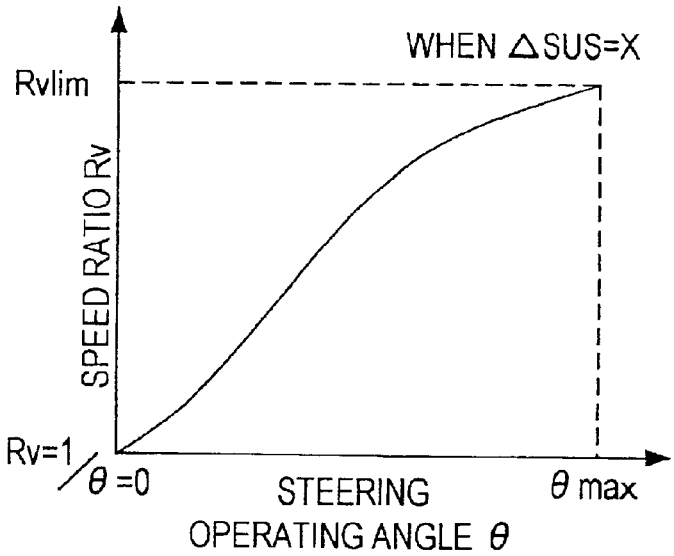

As illustrated in FIG. 12B, the correspondence between the operating angle θ of the steering 54 and the speed ratio Rv of the motors is set for every ΔSUS. More specifically, assuming that the motor limit speed ratio Rvlim can be obtained according to the speed of the car V given by FIG. 12A when the steering 54 is operated to the maximum operating angle θmax, the correspondence between the speed ratio Rv of the motors 28 and 28 and the operating angle θ of the steering 54 up to the maximum operating angle θmax is set for every ΔSUS. Although the line graph of FIG. 12B is set for every ΔSUS in order to provide proper setting according to the steering quality, the line graph of FIG. 12B may be always constant regardless of ΔSUS. For example, the line graph of FIG. 12B may be always in direct proportion to ΔSUS.

Figure 13:
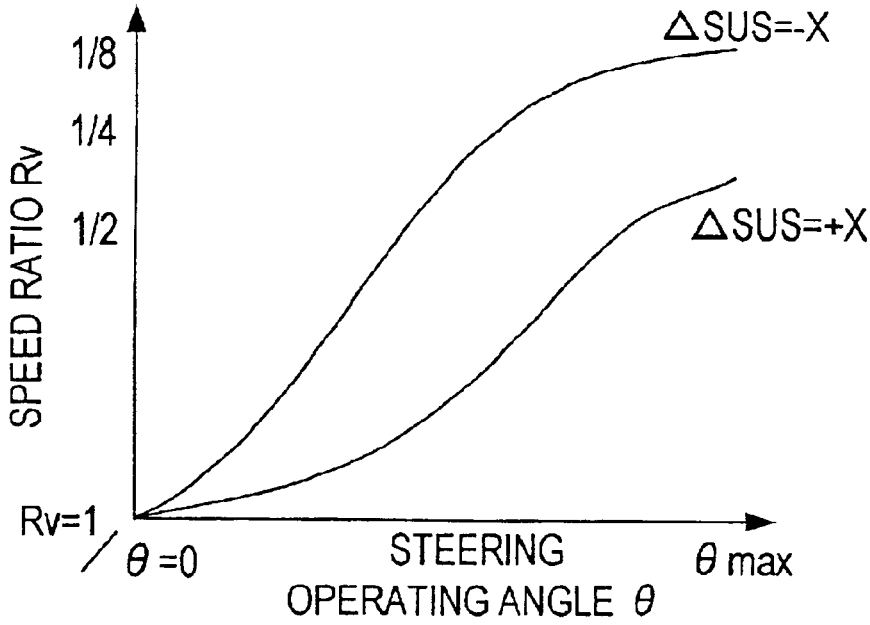
FIG. 13 is a diagram showing another setting example of a correspondence between the operation amount of the steering and the speed ratio of the motors.

Although the speed of the car has been considered in the above setting, only the setting of the relationship between the steering operating angle θ and the speed ratio Rv of the motors 28 for every difference ΔSUS in the suspension set values is enough in the toy system of the present invention, without considering the speed of the car. Namely, although in the example of FIG. 12B, the limit speed ratio Rvlim is drawn from the line graph of FIG. 12A according to the speed of the car V, the system may be set, without the setting of the limit speed ratio Rvlim by consideration of the speed of the car V, in such a way that the steering operating angle θ can be directly corresponded with the speed ratio Rv, as illustrated in FIG. 13, the line graph showing the correspondence between the steering operating angle θ and the speed ratio Rv can be brought near to 1 according as the suspension set value ΔSUS is larger in a positive direction, so to generate the under-steer quality, and that the line graph can be more lowered from 1 according as ΔSUS is larger in a negative direction, so to generate the over-steer quality. In any case of FIG. 12B and FIG. 13, the speed ratio Rv is gradually decreased according as the steering operating angle θ is more increased from 0.

The data of each line graph for specifying the correspondence between the respective operation amount θ and ϕ of the steering 54 and the throttle lever 55 and the motor control information as mentioned above is stored in the storage 10*a* of the transmission unit 2. When creating the motor control information of FIG. 4 for the model car 20, the control circuit 10 of the transmission unit 2 reads out the setting state stored in the storage 10*a*, detects the respective operation amount θ and ϕ of the current steering 54 and throttle lever 55, and specifies the rotation direction and the moving speed of the motors 28 and 28 corresponding to these detected values according to the data of each line graph, hence to create the motor control information.

Each line graph shown in FIG. 11 and FIG. 12 is to be decided previously by a provider (designer or manufacturer) of the toy system SY1 in every set value of each item. A user only designates which line graph to select in order to decide the control quality, of the line graphs for every set value previously prepared, by the set value (one of 1 to 8) of every item, and a user cannot change the line graph itself at his or her will.

Figure 14:
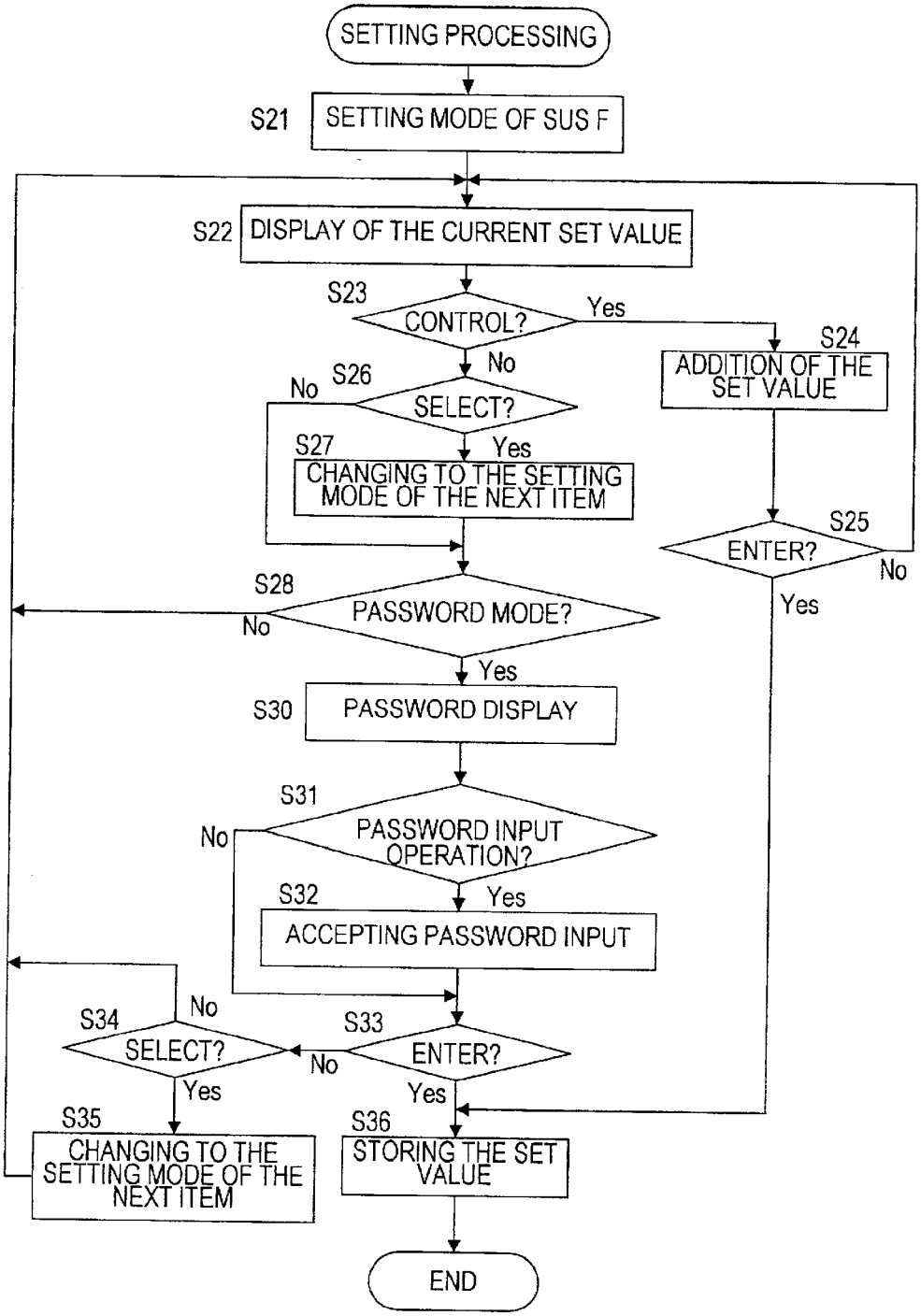
FIG. 14 is a flow chart of the setting processing executed by the control circuit of the transmission unit in order to set the driving characteristic of the model car by use of the transmission unit.

FIG. 14 is a flow chart showing the procedure of the setting processing to be executed by the control circuit 10 of the transmission unit 2 when a user sets the above setting items by using the buttons 56 to 58 of FIG. 10B.

When a user of the transmission unit 2 pushes the select button 56 once, the control circuit 10 starts the processing of FIG. 14. In the first Step S21, the setting mode of the front suspension (corresponding to "SUS F" of FIG. 10B) is selected. Then, the set value of the setting item corresponding to the currently selected setting mode is displayed on the liquid crystal display 18 (Step S22).

Thereafter, whether the control button 57 is pushed or not is checked (Step S23), and when it is pushed, one is added to the set value of the setting item corresponding to the currently selected setting mode (Step S24). At a time of the maximum value 8, it will return to the minimum value 1. Then, whether the enter button 58 is pushed or not is checked (Step S25), and when it is not pushed, the processing will be returned to Step S22.

When the control button 57 is not pushed in Step S23, whether the select button 56 is pushed or not is checked (Step S26), and when it is pushed, the setting mode is changed to the setting mode of the next item (Step S27). The next item means the item specified next according to the order from top to down in the character information 71 to 75 in FIG. 10B, and the next item of the "PASS" proves to be the "SUS F". In order to make it easy for a user to check which setting mode is selected, it is preferably that the character information corresponding to the currently selected setting mode, of the character information 71 to 75, is displayed in a different form from the other character information.

When the select button 56 is not pushed in Step S26 of FIG. 14, Step S27 is omitted. In the next Step S28, whether the current setting mode is a password mode or not (corresponding to the "PASS" in FIG. 10B) is judged. When it is not the password mode, the processing will be returned to Step S22.

When it judges to be the password mode in Step S28, a password formed by combining the set values of each setting item at that time is displayed on the liquid crystal display 18 (Step S30), and whether a predetermined password setting operation is performed on the push button switches 56 to 58 or not is checked (Step S31). When the password setting operation is performed, the processing for accepting a password input is performed (Step S32), and thereafter whether the enter button 58 is pushed or not is checked (Step S33). When Step S31 is denied, Step S32 is skipped. When the enter button 58 is not pushed, whether the select button 56 is pushed or not is checked (Step S34). When the select button 56 is pushed, the setting mode is changed to the setting mode of the next item (Step S35), and the processing thereafter will be returned to Step S22. When Step S34 is denied, Step S35 is skipped.

When it judges that the enter button 58 has been pushed in Step S25 or Step S33, the processing for storing the set value at that time into the storage 10*a* is performed (Step S36) and then the processing of FIG. 14 will be completed.

According to the above processing, a user can select a mode corresponding to the item on which he or she wants to change the setting, by the operation of the select button 56, and he or she can change the set value as it is by the operation of the control button 57. When a user selects the password mode, he or she can enter any password. As mentioned above, since the password corresponds to each set value from 1 to 8 of the four setting items, each setting item can be set at a desired value at once by entering the password.

Further, a special setting code may be entered by using the password. For example, when a specified password including the numeral, 0 or 9, not used as the set value of the four setting items is supplied, it may be designed such that there will appear a special setting state incapable of the setting by the operation of the select button 56 and the control button 57. As the special setting state, there are such a setting that the forward driving or the backward driving is made impossible and such a tricky setting that a sideslip of a car body would occur by instant stopping of one wheel or inversing the rotation thereof, in a special operation state.

[Description of the Play Extension System]

As illustrated in FIG. 1, the play extension system SY2 is formed as a content provider site connected to the Internet 100, and it includes a Web server 101, a database server 102 for controlling various databases 111 to 114 according to an instruction from the Web server 101, and a mail server 103 for controlling the transmission/receiving of a mail.

In addition to a predetermined Web server software for working as a window of access through the Internet 100, a setting check program, a ranking analysis program, and an invitation card delivering program running by use of, for example, CGI (abbreviation of Common Gateway Interface) are installed in the Web server 101, in order to provide a special service for extending the playing way of the toy system SY1 to enhance the fun. These programs may be executed by a Web application server other than the Web server 101.

While, a user of the toy system SY1 can get access to the play extension system SY2 from a predetermined user terminal 120 through an access point 130, a service provider network 131, and the Internet 100. The user terminal 120 is formed by a computer comprising a microprocessor, a memory, a display, an input device and the like, and it has to be provided with a Web browser function capable of interpreting the HTTP protocol and browsing the Web contents and an environment capable of executing a program supplied as an applet for the Web page (typically, JAVA applet (registered trademark)). Here, a portable telephone, by way of example, is used as the user terminal 120.

As the database controlled by the database server 102, there are provided a member database 111, a setting database 112, a game database 113, and a score ranking database 114. The member database 111 stores various information of a member qualified to use the play extension system SY2. For example, user registration information is obtained from a user who purchased the remote operational toy system SY1, to issue a user ID and a password necessary for providing the service of the system SY2, and the information is stored into the member database 111 so as to be associated with the corresponding user personal information.

The setting database 112 is a database for storing a password formed by combining the respective set values of the four items; front suspension (SUS F), rear suspension (SUS R), brake (BRAKE), and turbo (TURBO), settable by a user through the transmission unit 2 in the remote operational toy system SY1, together with the corresponding information indicating its estimation.

More specifically, in the remote operational toy system SY1, as the parameter for controlling the operating characteristic of the model car 20, the setting for the turbo, the brake, and ΔSUS which is regarded as the difference of the hardness of the suspension is prepared, and the operating characteristic (control quality) of the model car 20 corresponding to these set values, namely, the correspondence between each operation of the steering 54 and the throttle lever 55 of the transmission unit 2 and a change of rotation in the motors 28 is predetermined for every combination of the set values by a provider of the toy system SY1, as illustrated in FIG. 11 and FIG. 12. The operating characteristic of the model car 20 varies depending on the combination of these set values. In some combination, everyone can operate the model car easily, and in other combination, the operating characteristic is so severe, although the potential is high, that a beginner cannot operate it well.

Therefore, on the side of a provider, the operating characteristic is estimated on every setting state specified by all the possible passwords, and the setting database 112 is built for storing information of estimation so as to be associated with the respective passwords. Thus built setting database 112 is used for checking the setting state by a user. The estimation information is created as the sentence information for expressing the feature of the setting state specified by a password (setting information), or as the sentence information for giving a user a clue of improving the setting state, which information can be stored into the database 112.

The game database 113 stores the contents of a game and the like to be delivered to a member of the play extension system SY2. Here, in this embodiment, in order to transfer a game program to the user terminal 120 to thereby enable the game play without having access to a network, an application program for a race which can be transmitted to the user terminal 120 through the Web server 101 is stored in the game database 113. This program is formed as an applet operatable on the user terminal 120 as mentioned above. Here, the application program for a race may be an operatable one on the play extension system SY2. A server for delivering the application program for a race may be provided separately from the Web server 101.

The score ranking database 114 is a database for receiving the information of the score and the like obtained by a user in a race game executed according to the application program for a race, from the user terminal 120 and for storing the same information so as to be associated with the user specifying information (for example, a user ID). The score includes all the information that reflects the user's achievement of a game, even if it does not have the form of points directly, for example, like a lap time in a race game.

The content of the processing to be executed by each program of FIG. 1 will be described with reference to FIG. 15 to FIG. 22. In the below, a description of the general processing performed in order to exchange information between the Web server 101 and the user terminal 120 will be omitted.

Figure 15:
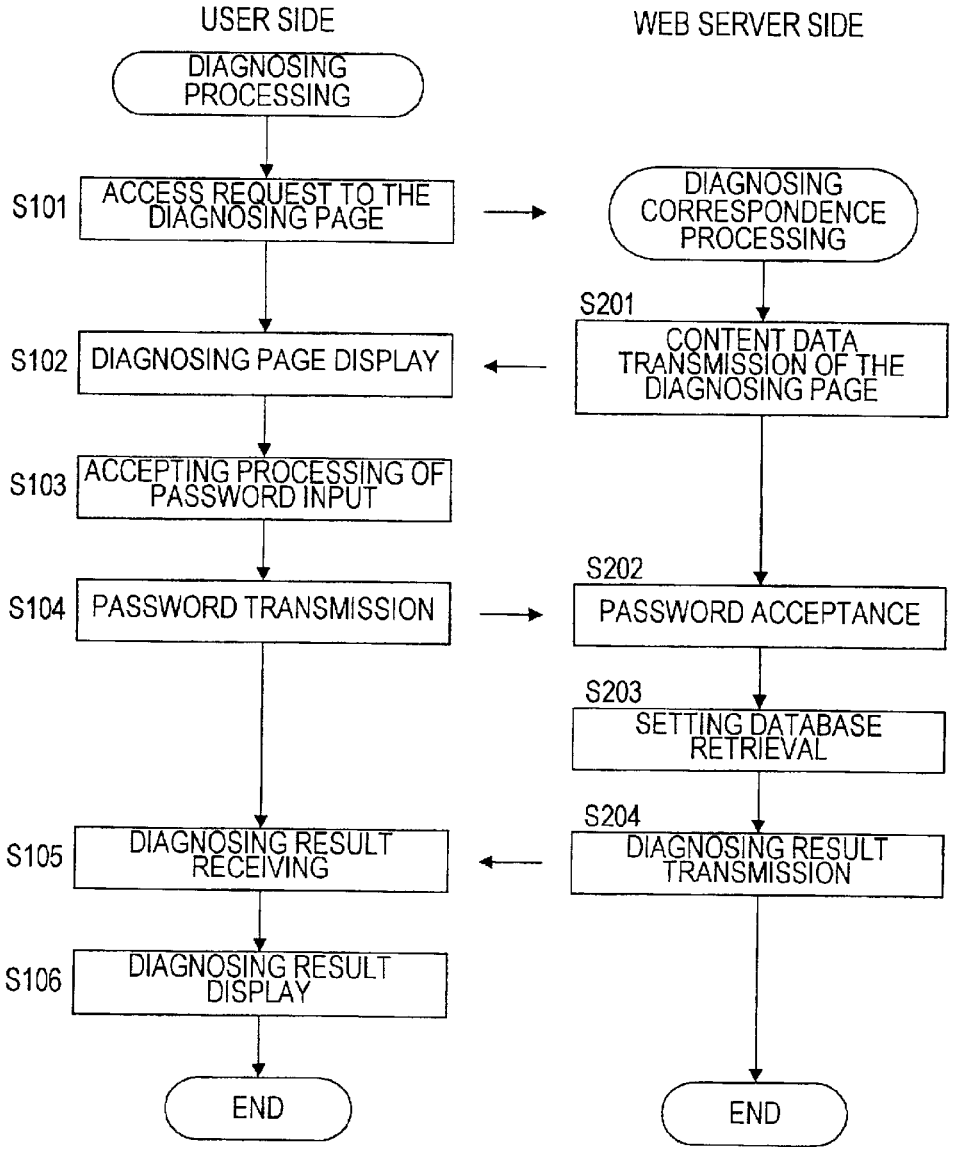
FIG. 15 is a flow chart showing the procedure of the processing executed by the user terminal and the Web server when the play extension system of FIG. 1 provides a setting check service.

FIG. 15 is a flow chart showing the procedure of the setting diagnosing service provided by the setting diagnosing program; the left side of FIG. 15 shows the processing realized on the user terminal 120 by using the Web browser and the right side of FIG. 15 shows the processing executed by the Web server 101.

Figure 16A:
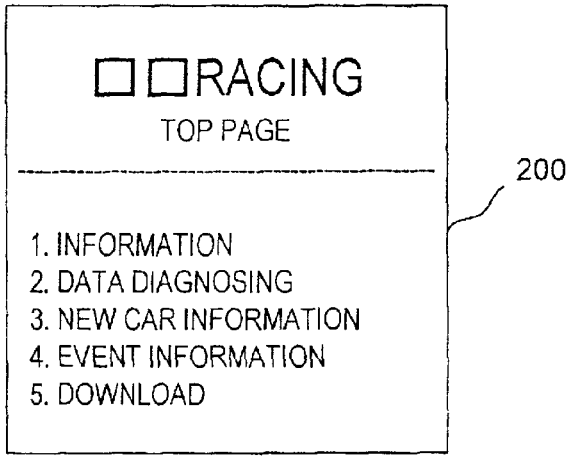
FIGS. 16A to 16C are diagrams showing an example of the screen displayed on the user terminal according to the processing of FIG. 15.

When a user activates the Web browser and the information for specifying the URL assigned to the start page of the Web site of the play extension system SY2 is transmitted to the Internet 100, the information necessary for displaying the top page is transmitted from the Web server 101 to the user terminal 120 and the top page 200 as shown in FIG. 16A appears on the display of the user terminal 120. The top page 200 includes "DATA DIAGNOSING" and "DOWNLOAD" as user's selectable items. This hierarchy and display position may be set freely. When selecting the "DOWNLOAD", the application program for a race and the data used for the same can be downloaded into the user terminal 120 from the Web server 101 according to a predetermined procedure. The procedure is omitted here.

When a user selects the "DATA DIAGNOSING" from the top page 200 and performs a predetermined deciding operation, the processing of FIG. 15 starts on the user terminal 120 by using the function of the Web browser, and the user terminal 120 transmits the Web server 101 an access request to a data diagnosing page (Step S101). Upon receipt of this, the Web server 101 starts the processing according to the setting diagnosing program and transmits the user terminal 120 various contents necessary for displaying the requested diagnosing page on the user terminal 120 (Step S201).

Figure 16B:
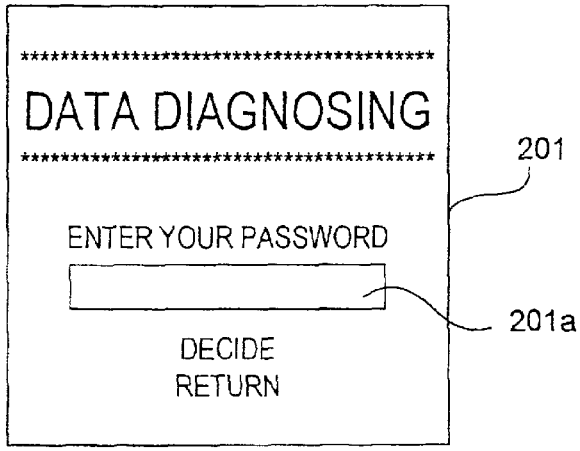

The user terminal 120, upon receipt of the contents, displays the diagnosing page 201, as illustrated in FIG. 16B (Steps S102), and accepts a password input in an input box 210*a* of the diagnosing page 201 (Step S103). The password requested to be entered here is the above-mentioned password of four digits which specifies the setting state of the transmission unit 2. A password which can be entered does not have to be limited to the password corresponding to the user's current setting state. Any password will do which a user wants to diagnosing.

When a user enters a password and performs the deciding operation, the user terminal 120 transmits the password to the Web server 101 (Step S104). The Web server 101 receives the password (Step S202), and thereafter, collaborating with the database server 102, obtains the estimation information corresponding to the password through retrieving the setting database 112 (Step S203). Then, it transmits the obtained estimation information to the user terminal 120 as the diagnosing result (Step S204).

Figure 16C:
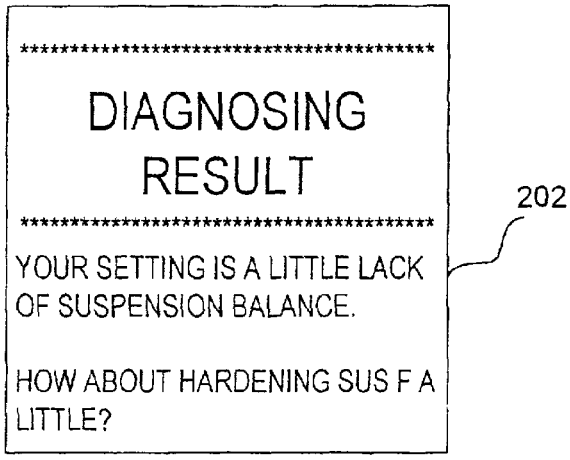

The user terminal 120 receives the transmitted diagnosing result (Step S105), and displays the received diagnosing result, for example, as illustrated in FIG. 16C (Step S106). Thus, the processing of the setting diagnosing service has been completed.

According to the above processing, a user of the toy system SY1 transmits the setting state of his or her own transmission unit 2 to the support system SY2 as a password, thereby obtaining the information for estimating the setting state specified by the password. The estimation information can include a comment on the setting state and an advice for improving the setting state, as illustrated in FIG. 16C, and it is possible for a user to know the objective estimation about his or her own setting state from the obtained information, hence to improve the setting state based on the estimation, or to try to play in the lowly-estimated setting state.

A race game to be executed on the user terminal 120 according to the application program for a race will be described with reference to FIG. 17 and FIG. 18.

Figure 17:
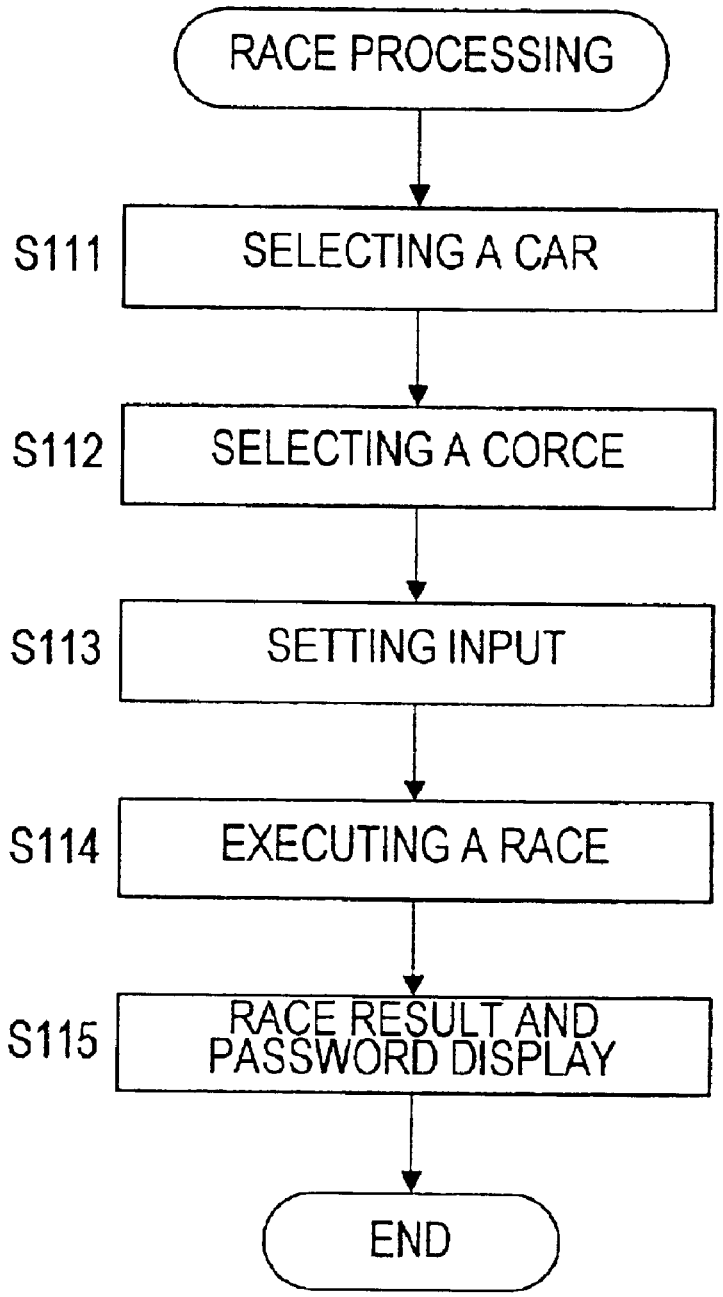
FIG. 17 is a flow chart showing the procedure of the race processing executed on the user terminal according to the race application program delivered from the Web server.
Figure 18A:
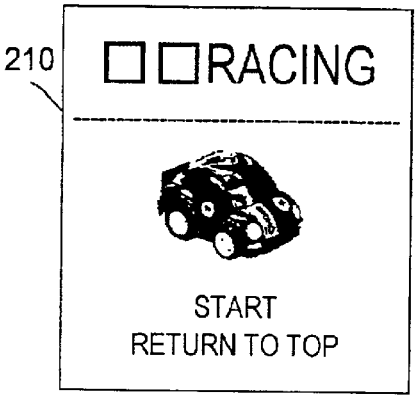
FIGS. 18A to 18F are diagrams showing an example of the screen displayed on the user terminal according to the processing of FIG. 17.

When a user downloads the application program for a race into the user terminal 120 and then executes the same program, a race mode screen 210 shown in FIG. 18A appears. With the race mode screen 210 displayed, when a user performs a predetermined start operation, the race processing of FIG. 17 starts on the user terminal 120. In the first Step S111, car selecting processing is performed. In this processing, for example, a car selection screen 211 shown in FIG. 18B appears and a user can select one car of a plurality of cars represented.

Figure 18D:
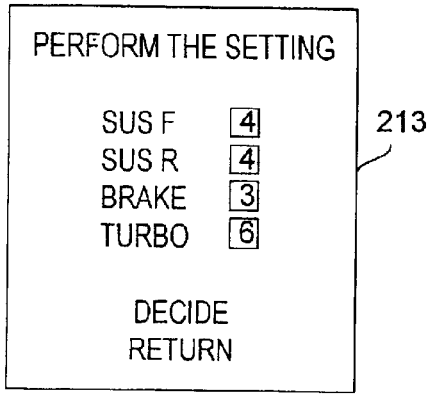
Figure 18B:
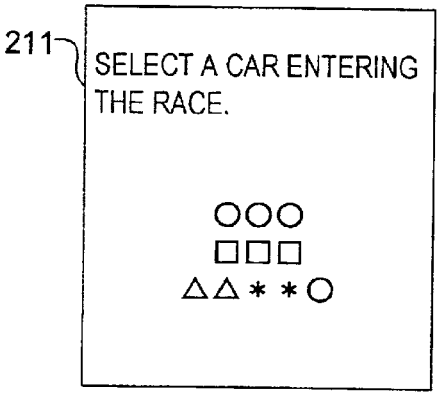

When the selection of a car is finished, course selecting processing is performed (Step S112). In this processing, for example, a course selection screen 212 shown in FIG. 18C appears, and a user can select one course having a race from a plurality of the courses represented there. When a course is selected, the processing for entering the setting of the car is performed (Step S113). As illustrated in FIG. 18D, the same items as the four setting items in the toy system SY1 are displayed on the screen, and a user can specify some set value of 8 steps from 1 to 8, for each item, similarly to the toy system SY1.

Figure 18E:
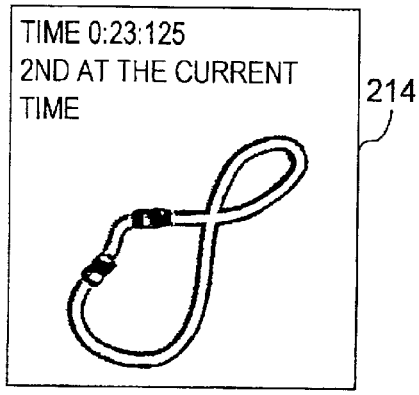
Figure 18C:
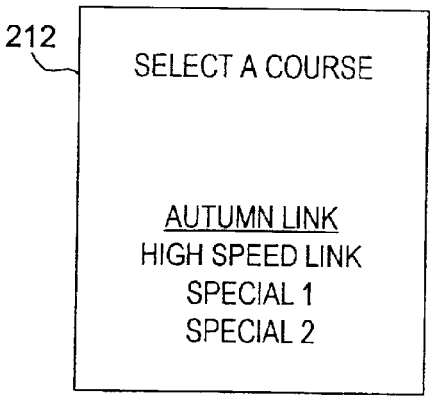

When the setting is finished, the race is executed (Step S114). Here, for example, a race screen 214 indicating the race scene dynamically is displayed, as illustrated in FIG. 18E. In this race, a user can not drive a car, but the central processing unit (CPU) of the user terminal 120 sequentially calculates the progress of the race according to the race program.

Calculation of the race state can be performed, for example, by referring to the course selected in Step S112 and the setting supplied in Step S113. For example, calculation expression of the race state is set so as to run a car faster in the setting superior in speed than in the setting superior in cornering performance when a course capable of high speed running is selected, and so as to run a car faster in the setting superior in acceleration performance at a medium or low speed and in the cornering performance than in the setting superior in speed when a course having a lot of curves is selected.

The correspondence between the car characteristic and the values of the setting supplied in Step S113 is predetermined to be similar to the correspondence between a password in the toy system SY1 and the driving characteristic (control quality) of the model car 20 specified by the password. For example, when there is the setting state (password) for obtaining in which such a driving characteristic that the maximum speed is high but that the cornering is difficult in the toy system SY1, the performance of a car will be set at the same setting; the maximum speed is high but the cornering is difficult, if entering the same setting value in Step S113. By setting in the above way, a user can feel a correlation between the achievement of the virtual race held on the screen and the achievement when a race is held in the toy system SY1.

Figure 18F:
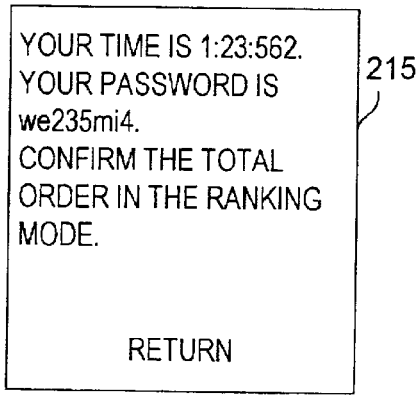

When a race progresses to a predetermined end position, the race is over, and the processing will be advanced to Step S115 of FIG. 17, where the race result and the password are displayed, for example, as illustrated on the screen 215 of FIG. 18F, thereby finishing the race processing of FIG. 17. As apparent from FIG. 18F, the race result is displayed as time. Here, different from the above-mentioned password reflecting the setting state, this password is the character string for use in the ranking mode processing described next, including the information for specifying at least the course, time, and setting of the race.

Figure 19:
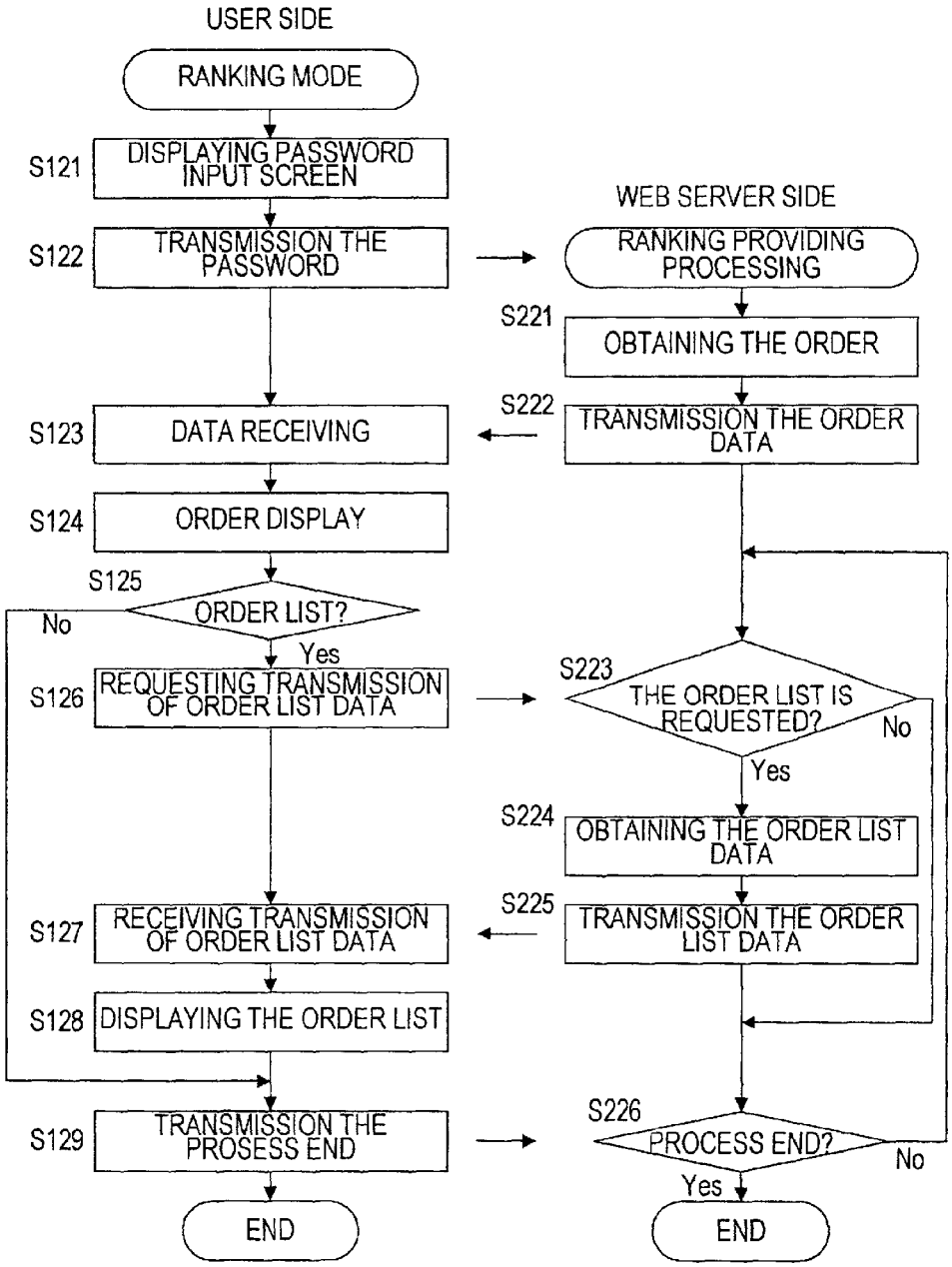
FIG. 19 is a flow chart showing the procedure of the processing executed by the user terminal and the Web server when the play extension system of FIG. 1 provides a ranking analysis service.

FIG. 19 is a flow chart showing the procedure of a ranking providing service provided by the ranking analysis program; the left side of FIG. 19 shows the processing to be realized on the user terminal 120 by using the Web browser, and the right side of FIG. 19 shows the processing to be executed by the Web server 101. This service starts when a user operates the terminal 120 so as to get access to a predetermined ranking page on the Web server 101, and in the first Step S121, a predetermined password input screen 220 shown in FIG. 20A is displayed on the user terminal 120. When a user supplies the password issued in the race processing of FIG. 17 to the input box of the password input screen 220, the user terminal 120 transmits the password to the Web server 101 (Step S122).

Upon receipt of the password, the Web server 101 starts the processing according to the ranking analysis program, retrieves the score ranking database 114 with a clue of the received password, and obtains the order corresponding to the password transmitted by a user (Step S221). The order at this time is independently decided for every course. Thereafter, the Web server 101 transmits the data specifying the obtained order to the user terminal 120 (Step S222). The database server 102 stores the received password into the score ranking database 114 so as to be associated with the information specifying the order and the member identity. Thus, the data of the score ranking database 114 is updated every time a password specifying the course, time and setting is transmitted from the user terminal 120.

The user terminal 120 receives the order data transmitted from the Web server 101 (Step S123), and displays the order specified by the data, for example, like the screen 221 of FIG. 20B (Step S124). Thereafter, the user terminal 120 discriminates whether or not a user has done the operation for requesting the display of an order list (Step S125), and when this operation is done, the user terminal 120 requests the Web server 101 to transmit the order list data (Step S126).

On the other hand, the Web server 101 monitors whether the order list is requested from the user terminal 120 or not (Step S223), when it is requested, the Web server 101 obtains the order list data based on the data of the score ranking database 114 (Step S224), and transmits the order list data to the user terminal 120 (Step S225).

The user terminal 120 receives the order list data (Step S127), and based on the received data, for example, an order list screen 222 is displayed, as illustrated in FIG. 20C (Step S128). When a user does not desire the display of the order list, the processing of Step S126 to Step S128 is skipped, Step S223 is denied in the Web server 101, and Step S224 and Step S225 are skipped.

After displaying the order list, the user terminal 120 transmits the end of the process to the Web server 101 (Step S129). The Web server 101 judges whether the process should be finished or not according to the user terminal 120 transmission the process end or not (Step S226), and when it is not judged to be end, this step will return to Step S223, while when it is judged to be end, the processing of FIG. 19 is finished.

Figure 21:
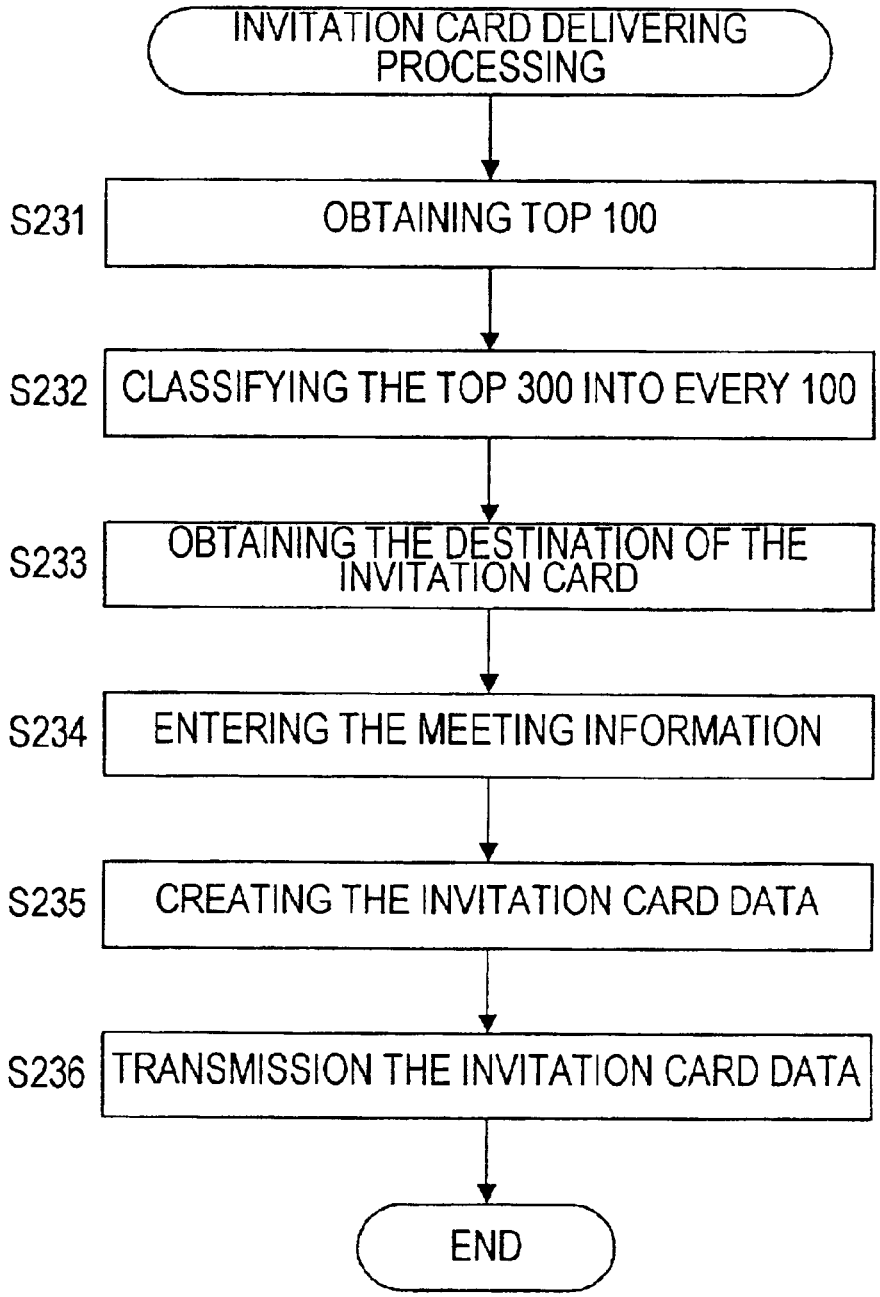
FIG. 21 is a flow chart showing the procedure of invitation card delivering processing executed by the Web server of the play extension system of FIG. 1.

FIG. 21 is a flow chart showing the procedure of the invitation card delivering processing to be executed by the Web server 101 according to the invitation card delivering program. This processing is to invite an excellent person registered in the score ranking database 114 to an actual meeting (race event) of the toy system SY1, and for example, a manager of the Web server 101 instructs its performance, thereby starting this processing. In the first Step S231, the top 300 persons are obtained with reference to the score registered in the score ranking database 114. The obtained 300 persons are classified by every 100 persons (Step S232), and the destination addresses of the invitation cards for the top persons are obtained from the member database 111 (Step S233). The destination address includes, for example, electronic mail address, general post address, fax/telephone number, and the like.

Next, the processing for inputting the information about the meeting for inputting the extracted 300 persons is performed (Step S234). A Web manager may enter the above information by hand, alternatively, the information about the meeting may be collected through the Internet 100 and the collected information may be automatically received. Upon receipt of the meeting information, the invitation card data is created (Step S235). For example, when an invitation card is delivered to a member from the mail server 103 using electronic mail, the text of the mail is created. When the invitation card data is created, the created card is transmitted to all the transmission destinations obtained in Step S233 (Step S236). Thus, the processing of FIG. 21 is completed.

FIG. 22 shows an example of an invitation card screen 230 displayed on the user terminal 120 when an invitation card is delivered to the user terminal 120 as an electronic mail. As illustrated in this example, the setting for the toy system SY1 is specified on the invitation card screen 23 together with at least the date and the place of the meeting and the rank of the invited user. Specified by the password issued in Step S115 of FIG. 17, the setting corresponds to the set values of the setting used by a user in the race processing of FIG. 17.

In the meeting, a user is obliged to supply the setting specified by the invitation card of FIG. 22 as the password, to the transmission unit 2, with the result that a correlation is established between the ranking defined in the score ranking database 114 of FIG. 17 and the performance of the toy system SY1 of the participants. The participants are classified according to the ranking database 114, hence to even the ability of the participants. On the other hand, a driving ability of the model car 20 becomes an important element in the actual game meeting, so that only the performance of a car does not decide the game necessarily. Accordingly, an exciting race can be expected in each class.

The present invention is not limited to the above-mentioned embodiment, but various modifications are possible. For example, the driving machine 1 of the toy system SY1 is not limited to a car, but it may be a tank and a vessel. Further, it is not limited to a self-running type, but the present invention may be adopted to, for example, the operation of a robot, a doll and the like. The toy system combined with the play extension system of the present invention is not limited to a remote-controlled one, but a user may directly operate it. Further, the present invention can be adopted to a toy system in which a user is never involved in the operation but user only sets the parameters. The user terminal is not limited to a portable telephone, but any computer will do as far as it can execute a game provided from the play extension system. Further, the present invention is not limited to the example of executing a game on the user terminal, but with a game executed on the play extension system, the electronic information for displaying the execution state may be transmitted to the user terminal.

As described above, according to the present invention, objective estimation on the setting state of a toy system can be supplied to a user by using a network, or a game representing a virtual play of a toy system can be played by a user through a network, thereby enhancing the fun of this kind of toy system by extending the playing way of only the toy system.

What is claimed is:

1. A play extension system to be used by combination with a toy system in which a user can change setting of parameters affecting motion control of a driving machine, the system comprising:

a server and a user terminal which are accessible via a network;

the user terminal comprising;

a setting input device for accepting setting information corresponding to a setting state of the parameters, the setting information being input by a user, the server comprising;

an information obtaining device for receiving setting information received by the setting input device from the user terminal through the network;

an estimation creating device for creating estimation information, the estimation information containing the setting information obtained by the information obtaining device, referring to a database in which the setting information and information for estimating the setting state are stored correspondingly with each other; and an estimation transmission device for transmitting the created estimation to a predetermined destination through the network;

said estimating information comprising one or more of characteristics of the setting state specified in the setting information and clues for improving the setting state;

said estimating information being stored in the database; and said estimation transmission device transmitting to the user terminal, through the network, information for displaying said estimation information.

2. The play extension system according to claim 1, wherein the toy system presents the information for specifying the user's setting state of the parameters to the user, and the information obtaining device obtains the information presented to the user by the toy system, from the user terminal, as the setting information.

3. The play extension system according to claim 1, wherein the toy system comprises a driving machine and a transmission unit for a user's remote-controlling of the driving machine, and the settable parameters are to affect a correspondence between an input operation of the transmission unit and a control amount of the driving machine based on a control signal transmitted from the transmission unit to the driving machine.

4. A computer readable recording medium recording program for constructing a play extension system comprising user terminals and one or a plurality of servers of a Web site, which system is used by combination with a toy system in which a user can change setting of parameters affecting motion control of a driving machine, wherein the program for the play extension system is designed to work the server as:

an information obtaining device for receiving setting information corresponding to a setting state of the parameters from each of the user terminals through a network, the setting information being input by the user to the user terminal;

an estimation creating device for creating estimation information, said estimation information containing the setting information obtained by the information obtaining device, referring to a database in which the setting information and information for estimating the setting state are stored correspondingly with each other;

an estimation transmission device for transmitting the created estimation to a predetermined destination through the network;

said estimation information comprising one or more of characteristics of the setting state specified in the setting information and clues for improving the setting state to the user;

said estimation information being stored in the database; and the estimation transmission device transmitting to the user terminal, through the network, information for displaying the estimation information.

* * * * *